US005265398A

United States Patent [19]

VanAlstine et al.

[11] Patent Number: 5,265,398

[45] Date of Patent: Nov. 30, 1993

[54] AUTOMATIC COUNTING AND BOXING MACHINE

[75] Inventors: Terrance L. VanAlstine, Palatine Bridge; Gerald B. Klump, Fort Plain, both of N.Y.

[73] Assignee: Superior Quality Products, Inc., Scotia, N.Y.

[21] Appl. No.: 891,660

[22] Filed: May 29, 1992

[51] Int. Cl.[5] ..... B65B 57/20; B65B 19/34

[52] U.S. Cl. ..... 53/444; 53/148; 53/236; 53/500

[58] Field of Search ..... 53/236, 444, 443, 251, 53/258, 255, 244, 245, 148, 500

[56] References Cited

U.S. PATENT DOCUMENTS

| | | | |
|---|---|---|---|
| 2,710,566 | 6/1955 | Ahlmeyer et al. | 493/316 |
| 3,004,374 | 10/1961 | Pembroke | 53/236 X |
| 3,014,323 | 12/1961 | Stephen | 53/236 X |
| 3,267,641 | 8/1966 | Molins | 53/236 X |
| 3,269,083 | 8/1966 | Marano | 53/535 |
| 3,365,857 | 1/1968 | Liedtke | 53/236 X |
| 3,367,248 | 2/1968 | Rhino et al. | 493/317 X |
| 3,504,596 | 4/1970 | Hirasuna | 93/313 X |
| 3,533,333 | 10/1970 | McIntyre | 93/313 X |
| 3,535,847 | 10/1970 | Strohmeier | 53/501 |
| 3,580,143 | 5/1971 | McIntyre | 93/313 |
| 3,895,479 | 7/1975 | Kastner | 53/236 X |
| 3,896,711 | 7/1975 | Vuilleumier | 493/316 X |
| 3,968,901 | 7/1976 | Peva, Jr. | 53/236 X |
| 4,183,192 | 1/1980 | Smaw | 53/236 X |
| 4,197,790 | 4/1980 | Dietrich et al. | 493/313 |
| 4,494,361 | 1/1985 | Barathon et al. | 53/553 |
| 4,604,852 | 8/1986 | Becker | 53/444 |
| 4,693,051 | 9/1987 | Mattei et al. | 53/537 X |
| 5,057,055 | 10/1991 | Michaud et al. | 452/51 |

FOREIGN PATENT DOCUMENTS

| | | | |
|---|---|---|---|
| 1-182202A | 7/1989 | Japan . | |
| 3-621(A) | 1/1991 | Japan | 493/316 |
| 148610A1 | 6/1989 | U.S.S.R. | 493/313 |
| 2040255 | 8/1980 | United Kingdom . | |

*Primary Examiner*—James F. Coan

*Attorney, Agent, or Firm*—Heslin & Rothenberg

[57] ABSTRACT

The present invention provides an automatic counting and boxing machine. The machine employs a rotatable drum with a plurality of vanes deposited on the outside surface thereof running parallel to the central axis of the drum. Adjacent to the drum is a mechanism for inserting in front of each vane of the drum long cylindrical objects. As the drum rotates it then deposits the long cylindrical objects into an adjacent collection chamber. The collection chamber has an elevator plate which can be moved between an upper and lower position. When the elevator plate is in an upper position, a compression plate extends and moves the long cylindrical objects into a box loading chamber which has a floor coplaner with the elevator plate when it is in its upper position. When the straws are transferred to the box loading chamber, the elevator plate drops to its lower position and continues to receive straws from the drum. After the compression plate retracts the elevator plate moves back to its original position. As a further enhancement, adjacent to the automatic counting and boxing machine is a box erection machine which erects flat folded boxes into fully formed boxes. The box assembler has a box receiver at its top to hold flat unformed boxes and a shuttle station at its bottom to receive the fully formed boxes. The boxes are drawn through an erection chamber between the box receiver and the shuttle station where the boxes are erected. A shuttle at the shuttle station receives the fully erected box and moves the box to a position adjacent to the box loading chamber to receive cylindrical objects contained therein.

28 Claims, 12 Drawing Sheets

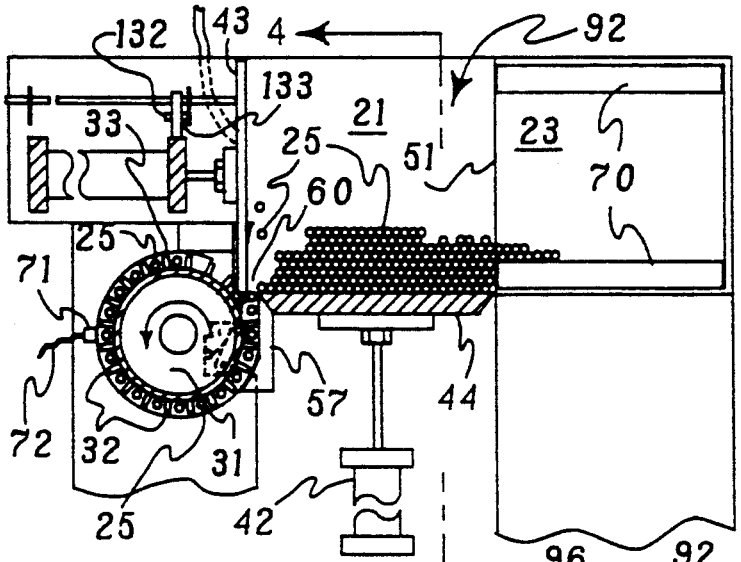
fig. 2A
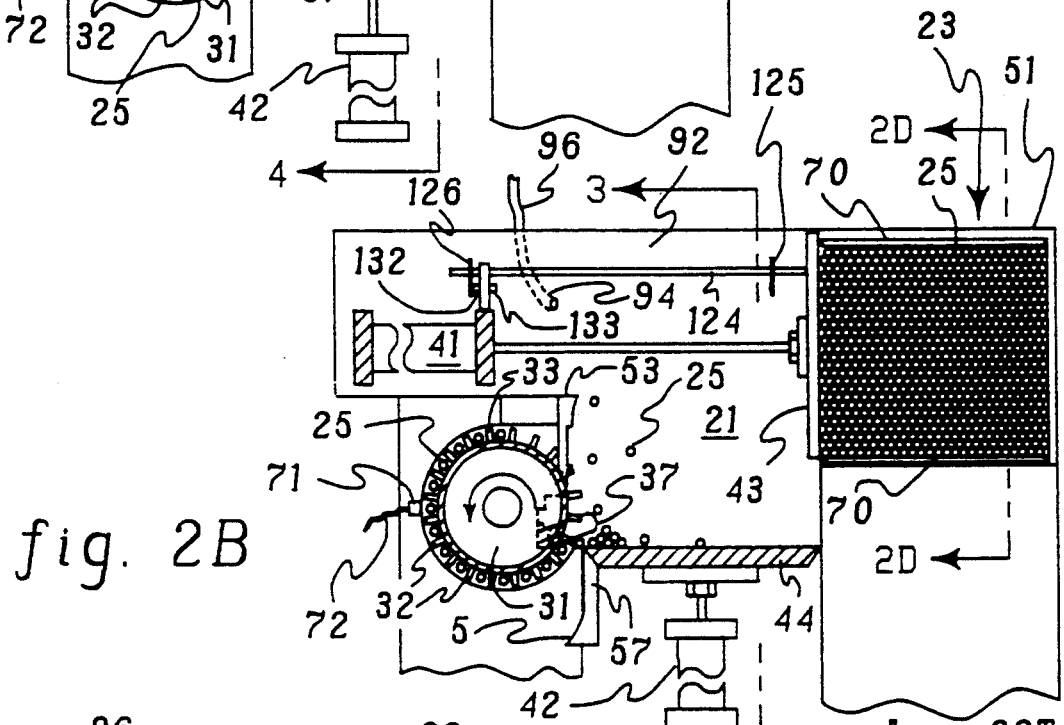
fig. 2B
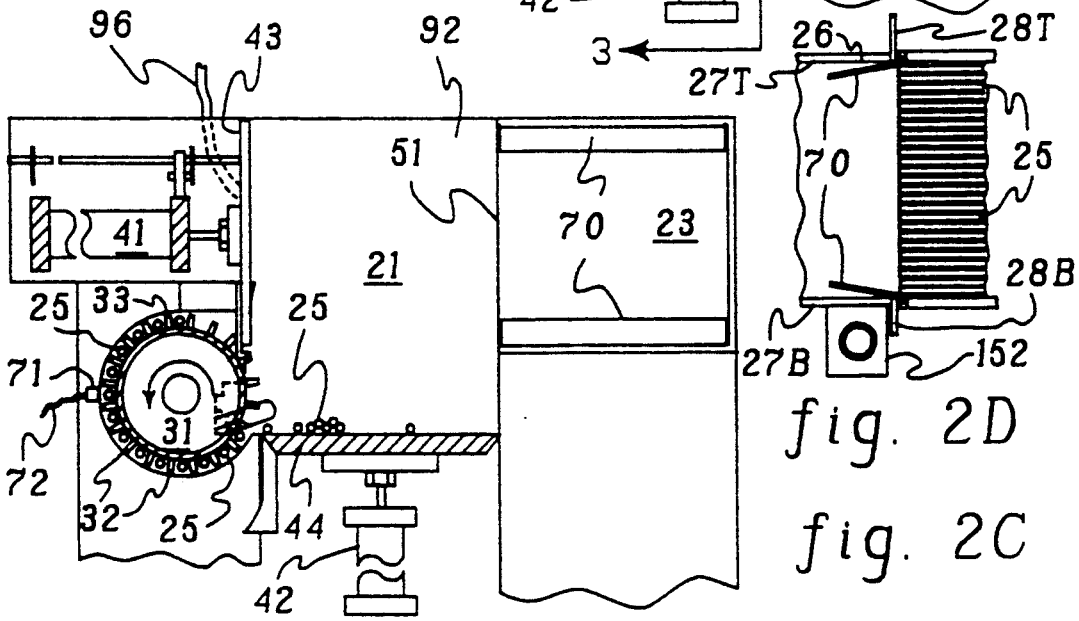
fig. 2D
fig. 2C 26
27B
27S
27T
28S
28T
30
49
79
81
82
83
85
86
87
88
89
90
91
95
161
161A
161B
161C
161D
161F
161G
161H
162

AUTOMATIC COUNTING AND BOXING MACHINE

TECHNICAL BACKGROUND

This invention relates to the counting, organizing and packaging of large numbers of similar items. Specifically, it deals with the counting and boxing of large numbers of cylindrically shaped objects such as straws or the like. The invention also deals with the erection and positioning of boxes into which the cylindrical objects which have been collected and counted are packaged.

BACKGROUND

Productivity, one of the driving forces in our present day economy, is an essential ingredient for a company to survive and prosper. An efficiently made, high quality product certainly enhances a company's chances for success. However, if the company produces a high volume and fungible product, such as candy, wrapped and packaged straws or the like, it must also be able to efficiently and cheaply accumulate, count and package its product. In fact, quite often the efficiency with which a producer of a fungible product deals with the handling and packaging of its product determines its success or failure.

Producers of low cost consumer items such as wrapped and packaged straws, candy and the like are under particular pressure to limit the cost of collecting, counting and packaging their product. Producers of such consumer products encounter a production bottle neck when it comes to counting and packaging their products since such activity often requires human intervention, given present day technology. Machines made according to current technology for the collecting, counting and packaging of straws require the presence of a human operator to gather the straws together after the machine has collected them and deposited them into a collection area. The human operator then has to assemble the box into which the straws will be placed and place those straws in the box. During any one eight hour shift an operator of such a machine can produce only eleven to twenty-five crates containing boxes of wrapped straws. There is also a problem with the operator putting the correct number of straws in each box. The apparatus of the present invention allows one human operator to operate three separate machines, made according to present invention, at the same time. Using the invention described herein, the productivity of each operator is increased to fifty to sixty-eight crates of boxed straws per eight hour shift.

OBJECT AND SUMMARY OF INVENTION

It is then an object of this invention to provide a machine which substantially reduces human intervention in the counting, bundling and packaging of light cylindrical objects such as straws or the like.

It is another object of this invention to provide a mechanism to automatically erect fully formed boxes for use in the packaging process with minimal operator intervention.

Briefly described, the apparatus of the invention employs a rotatable drum with a plurality of vanes disposed on the outside thereof running parallel to the central axis of the drum. Adjacent to the drum is a mechanism for inserting in front of each vane of the drum a long cylindrical object. As the drum rotates, it then rotationally positions and discharges the long cylindrical objects through an opening into an adjacent collection chamber.

The apparatus can also be enhanced with means for determining the number of objects transferred to the collection chamber and means for transferring a predetermined number of cylindrical objects from the collection chamber to a loading chamber.

The invention can be further enhanced with means for erecting and positioning flat folded boxes for loading with the cylindrical objects. The boxes being erected having a bottom panel, a top panel and two side panels. The erecting and positioning means has a box receiver at its top to receive and hold flat folded boxes and a shuttle station at its bottom of the machine for receiving an erected box. An erection chamber is located between the box receiver and the shuttle station. The erecting and positioning means includes means for drawing a bottom panel of a flat folded box from the receiver to the shuttle station through the erection chamber in substantially a horizontal orientation. Means are located in the erection chamber for urging the side panels of the box into a substantially horizontal relationship with the top and bottom panels so as to erect the box. A loading chamber is located in the proximity of the erection chamber. A shuttle operable between the shuttle station and the loading chamber receives the erected box at the shuttle station and carries it to the loading chamber.

The invention provides a method for continuously collecting and aligning groups of predetermined numbers of elongated objects using the multi-vaned drum, collection chamber with a floor moveable between an upper and a lower position and loading chamber adjacent to the collection chamber with a bottom plate coplaner with the floor of the collection chamber in its upper position. The drum is continuously rotated and one object is inserted in front of each vane as the drum rotates. The objects are then seriatim discharged from the drum into the collection chamber onto the floor while performing the following steps: 1.) moving the floor to its upper position; 2.) counting the objects deposited in the collection chamber until a predetermined number have been deposited on the floor; 3.) pushing the predetermined number of objects from the collection chamber to the loading chamber; 4.) moving the floor to its lower position; 5.) moving the floor back to its upper position before the predetermined number of objects has again been deposited in the collection chamber; and 6.) repeating steps 1 through 5.

The invention also has an electronic control mechanism to coordinate the operation of the counting and boxing machine, the box assembler machine and an associated straw wrapping machine. The electronic control mechanism is composed of appropriate electronic circuitry and buses, as well as an operator control panel and other electronic devices.

BRIEF DESCRIPTION OF DRAWINGS

The foregoing and other objects, features and advantages of the invention will be apparent from the following, more particular description of a preferred embodiment of the invention, as illustrated in the accompanying drawings, which are as follows:

FIG. 2A-1 is an enlarged mirrored view of a portion of FIG. 2A;

FIG. 2B-1 is an enlarged mirrored view of a portion of FIG. 2B;

FIG. 2C is a cross-sectional view of a portion of the invention taken in the direction of the arrows on lines 2—2 of FIG. 1 with the elevator plate at the lower position and the compression plate in a fully retracted position over the drum;

FIG. 2D shows details of the straw centering plates at the loading station.

FIG. 6A-1 is a view of the circled area;

FIG. 6B-1 is a perspective view of the box shuttle with a box located above it;

FIG. 6C-1 is a perspective view of the box shuttle holding a formed, empty box;

BEST MODE FOR CARRYING OUT THE INVENTION

1. Overall Operation

Figure 1:
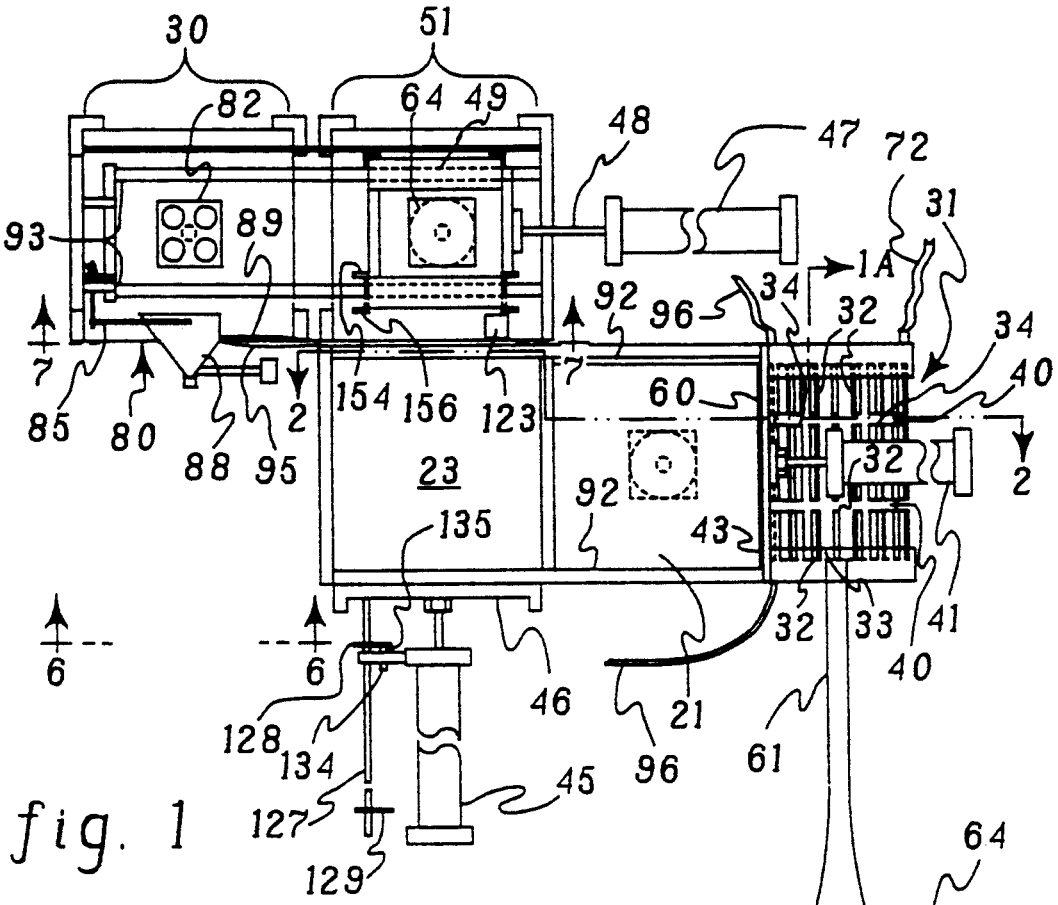
FIG. 1 is a plan view of the invention.

FIG. 1 is an overall plan view of the invention. The present invention is capable of collecting, counting and boxing elongated objects such as wrapped straws. Straw wrapping machines are well-known in the art; consequently, only that portion of the straw wrapping machine 62 that interfaces with the present invention is depicted. A long continuous strip of paper in which the straws are wrapped, is depicted at 63. Laying on the wrapping paper 63 are unwrapped straws 24. The straws 24 and wrapping paper 63 are conveyed through crimping wheels 64 which results in the straws being wrapped in the paper. The wrapped straws 25, not shown in FIG. 1, are then severed one at a time from strip 63 by a blade, also not shown, on one of the crimping wheels 64. As each straw leaves the crimping wheels 64, the straw accelerator 61 takes it and inserts it in front of a vane 32 on drum 31 at straw insertion slot 33. An alternative method of inserting straws in front of a vane, which is not depicted, could consist of a hopper located above the drum which would drop the straws down in front of the vanes as the drum rotates.

Figures 5A, 5B, 5C, 5D:
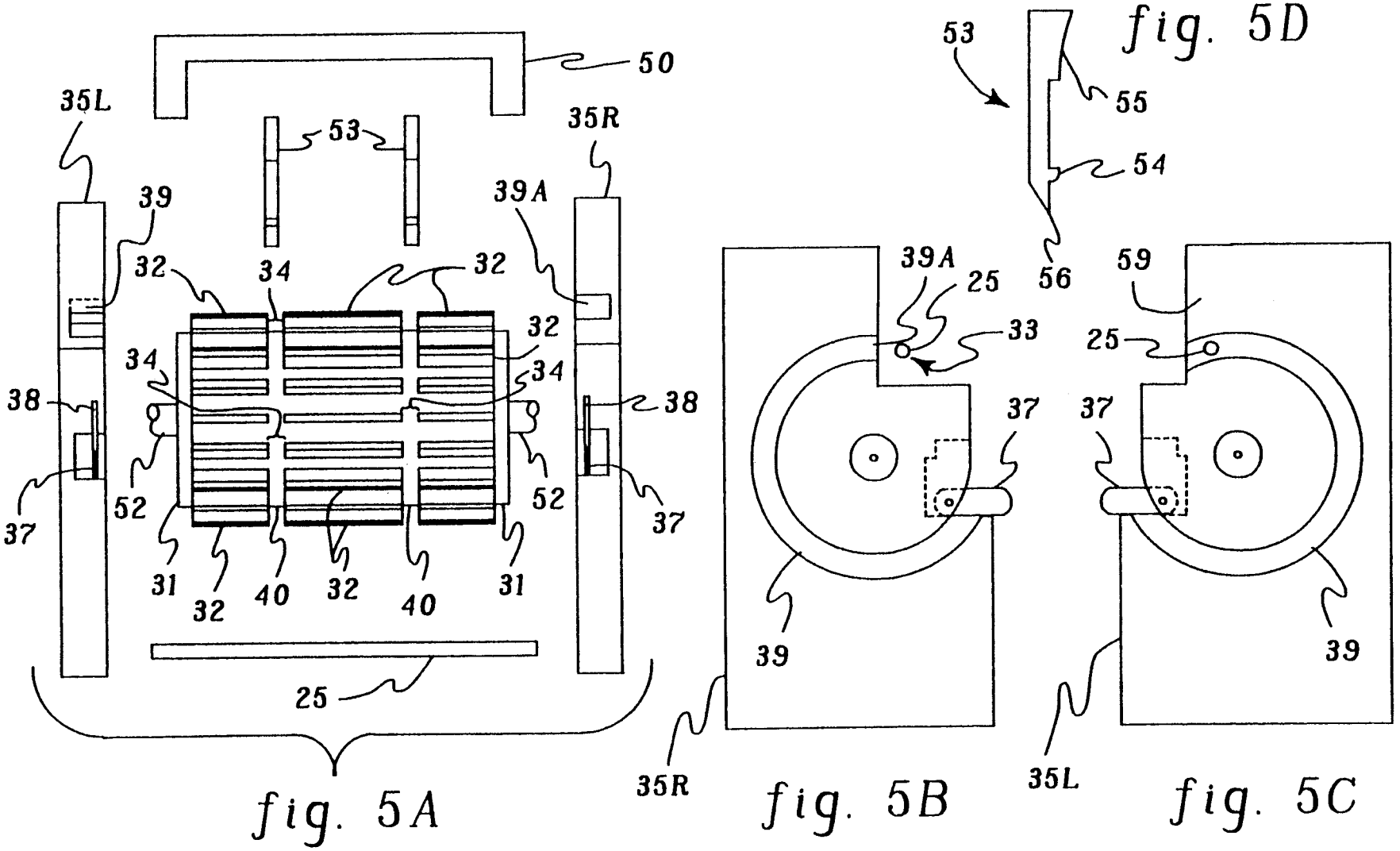
FIG. 5A is an exploded elevation of the drum, support plates, stripper fingers and support bar for the stripper fingers as viewed from the collection chamber.
FIG. 5B is an elevated side view of the support plate on the right in FIG. 5A.
FIG. 5C is an elevated side view of the support plate on the left in FIG. 5A.
FIG. 5D is an elevated side view of a combined stripper finger and discharge cam.

The vanes 32 are located on the exterior curved surface of the drum and run parallel to the central axis of drum 31. Each vane 32 is separated into three sections by notches 34 which, in effect, create two passages 40 through the vanes, as best seen in FIG. 5A. Drum 31 rotates to the right as viewed in FIG. 1. As the drum 31 rotates, wrapped straws 25 are longitudinally projected by the straw accelerator 61 in front of each vane 32. The wrapped straws 25 are then conveyed around by the vanes 32 and drum 31 and transferred to a collection chamber 21 adjacent to the drum. When a predetermined number have been deposited in chamber 21, the wrapped straws 25 are moved by compression plate 43 to the box loading chamber 23. Hydraulic cylinder 41 drives compression plate 43 across collection chamber 21. Counter 71 counts the straws 25 deposited in chamber 21.

Once the wrapped straws 25 are in loading chamber 23, cylinder 45 drives loading plate 46 across box loading chamber 23 pushing the wrapped straws 25 by their ends into a box located at box loading station 51. An assembled, empty box located at box loading station 51 has one open end, which open end is facing into the box loading chamber 23. Once the box is filled with straws by loading plate 46 it is then removed from box loading station 51. The present invention uses a holding rack 65 depicted in FIG. 7 and 7A located above position 51. Lift plate 64 lifts the full box up to the rack 65 which then holds the full box until removed by an operator or a suitable mechanism.

The invention thus organizes all of the wrapped straws 25 by first aligning them parallel to each other and making their ends even when the wrapped straws 25 are placed in front of the vanes 32 of the drum 31. The invention then maintains that alignment when the wrapped straws are discharged into the collection chamber 21, then when moved to the box loading chamber 23 and then finally, into a box.

Referring back to FIG. 1, a separate mechanism, a box assembler 80, to be described below erects or assembles boxes which are then ready to be filled with straws. The boxes, after being assembled by box assembler 80 rest in a shuttle 49 located at a shuttle station 30 at the bottom of box assembler 80. Then cylinder 47, attached by shaft 48 to shuttle 49, retracts shaft 48 and draws the shuttle 49 on rails 93 to box loading station 51. At box loading station 51, the box is then in a position to be filled. Once the box is filled and lifted from the shuttle 49 to the full box holding rack 65 the shuttle 49 moves back to the shuttle station 30 at the box assembler 80 to receive another assembled empty box.

2. Straw Accelerator

Figure 1A:
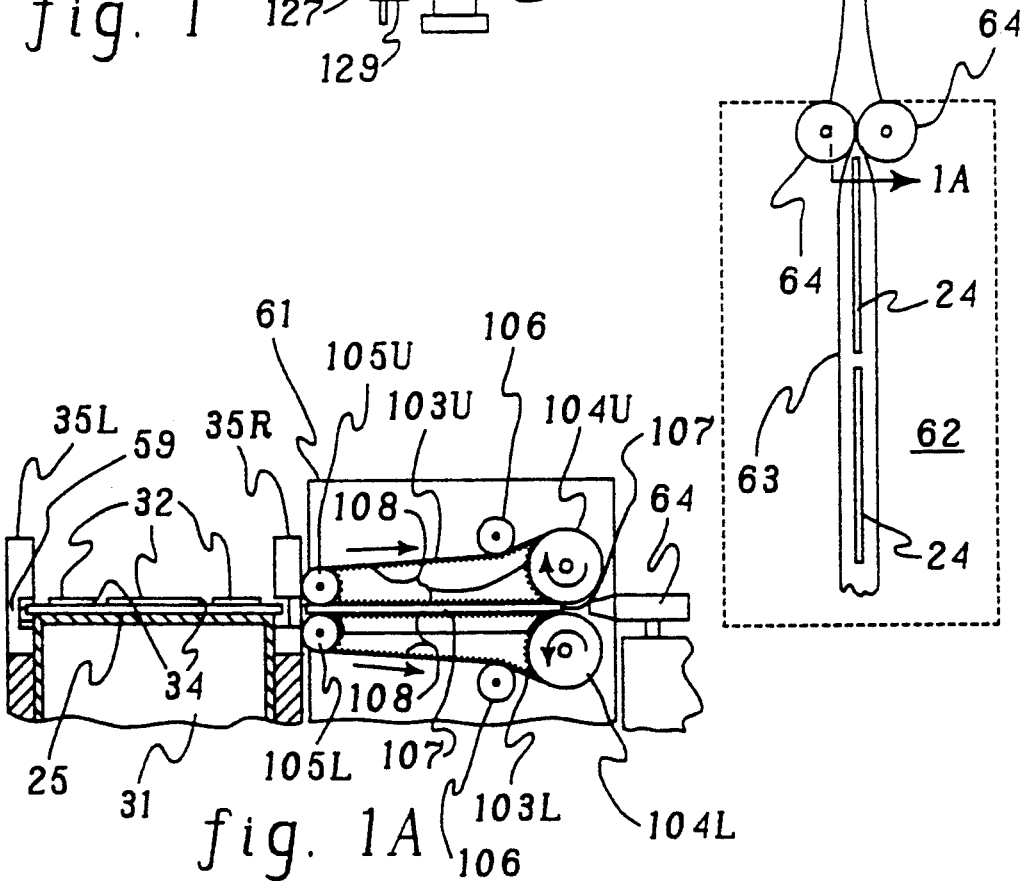
FIG. 1A is a cross-sectional view of the straw accelerator taken in the direction of the arrows on line 1A—1A of FIG. 1.

A cross sectional view of the straw accelerator illustrating its major components is depicted at FIG. 1A. FIG. 1A is an elevated cross sectional view along line 1A—1A of FIG. 1. The wrapped straws 25 from the straw wrapping machine 62 are ejected at the end of the straw wrapping machine by crimping wheels 64. Crimping wheels 64 are aligned with the straw channel 107 of the straw accelerator 61. As a wrapped straw 25 exits the crimping wheels it is inserted into the adjacent end of channel 107.

The straw accelerator consists of two endless belts 103U and 103L which move in the same direction. The longitudinal area between belts 103U and 103L where they run adjacent and parallel to each other is channel 107. Channel 107 has a height about equal to the thickness of a straw. Belt 103U moves in the direction indicated by the arrow above it and by the arrow on pulley 104U; belt 103L moves in the direction indicated by the arrow below it and the arrow on pulley 104L. The straw accelerator belts 103U and 103L grasp the straw on the top and bottom leading edges of the straw and pull the wrapped straw 25 into channel 107. The accelerator then accelerates the straw longitudinally along channel 107 to drum 31 and then projects the straw from channel 107 onto the drum 31 in front of a vane 32. Thus, straw accelerator 61 inserts and positions straw 25 in front of and parallel to a vane of the drum 31. The front of the vane 32 faces in the direction of movement of the drum 31 and vanes 32. In the preferred embodiment, the belts 103U and 103L are slightly wider than the thickness of a wrapped straw. Also, channel 107 has side walls, not shown, which help keep the straws properly aligned when the accelerator moves straws along channel 107.

When the straw is projected onto the drum 31 adjacent to a vane 32, the movement of the straw is stopped when the end of the straw 25 hits backstop 59 on support plate 35L, as shown in FIG. 1A. Support plate 35L and 35R are also depicted in FIGS. 5B and 5C. The backstop 59 can clearly be seen on FIG. 5C when FIG. 5B and 5C are compared. The spot the straws hit on backstop 59 is marked by the end of a straw 25. As illustrated in FIG. 1A, the backstop 59 is located on the side of drum 31 opposite the straw accelerator.

Referring to FIG. 1A, the two accelerator belts 103U and 103L have cogs 108 located along their inside surface. The cogs 108 on the two belts 103U and 103L intermesh with the cogs on the pulleys to which they are attached. Pulleys 104U and 104L are the drive pulleys that provide power which move the belts 103U and 103L, respectively. The power source and gear system used to control pulleys 104U and 104L are not shown since such devices are well known in the art. The gearing system causes pulleys 104U and 104L to rotate the same distance in opposite directions. Pulleys 105U and 105L are not powered and are driven by the belt to which they are attached.

The distance between the surfaces of belt 103U and 103L along channel 107 is adjusted such that they provide enough pressure to grip a straw 25 firmly, without damaging the straw 25 or its wrapping. The tension of the belts 103U and 103L can be adjusted by belt tension pulleys 106.

The preferred embodiment of the present invention uses a mechanical system to coordinate and synchronize the operation of the straw wrapping machine 62 and straw accelerator 61. The mechanical system consists of a timing belt 142, FIG. 10, running between a rotatable shaft 141 which is mechanically connected to the straw wrapper 62 and a rotatable shaft 143 which is mechanically connected to the straw accelerator 61. Consequently, when the operational velocity of the straw wrapper 62 is increased, there is an equivalent increase in the speed of operation of the straw accelerator 61. More concerning this aspect of the invention will be provided below.

3. The Automatic Counting and Boxing Mechanism

Figures 1, 2B:
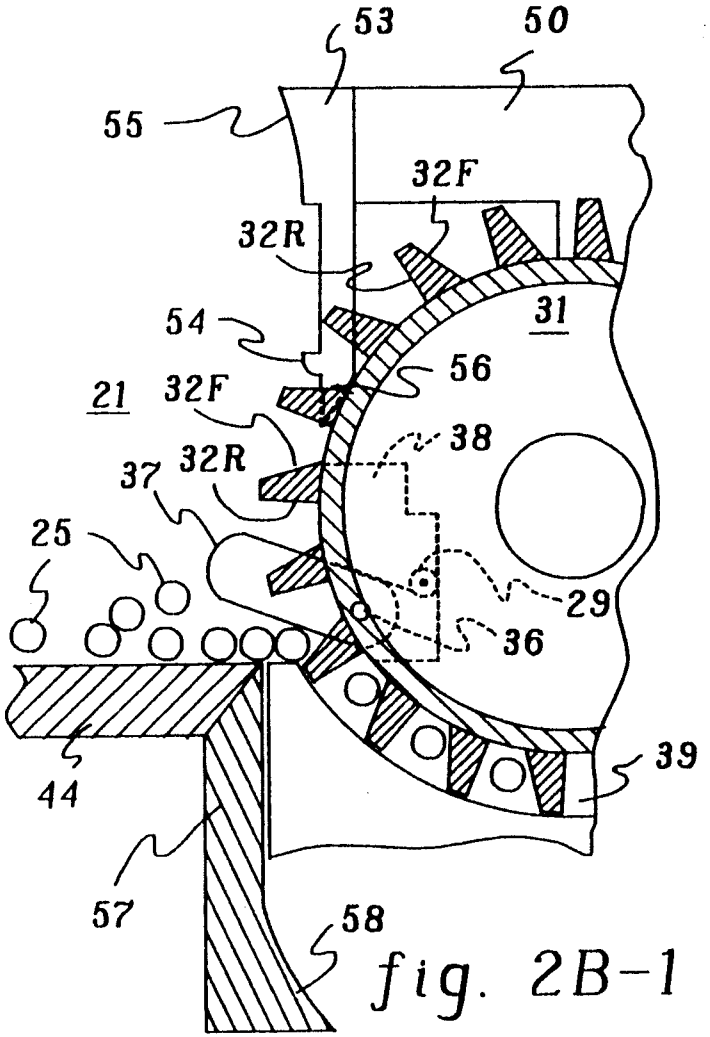
FIG. 2B is a cross-sectional view of a portion of the invention taken in the direction of the arrows on line 2—2 of FIG. 1 depicting the elevator plate in the lower position and the compression plate in a fully extended position adjacent to the box loading area.
Figures 1, 2A:
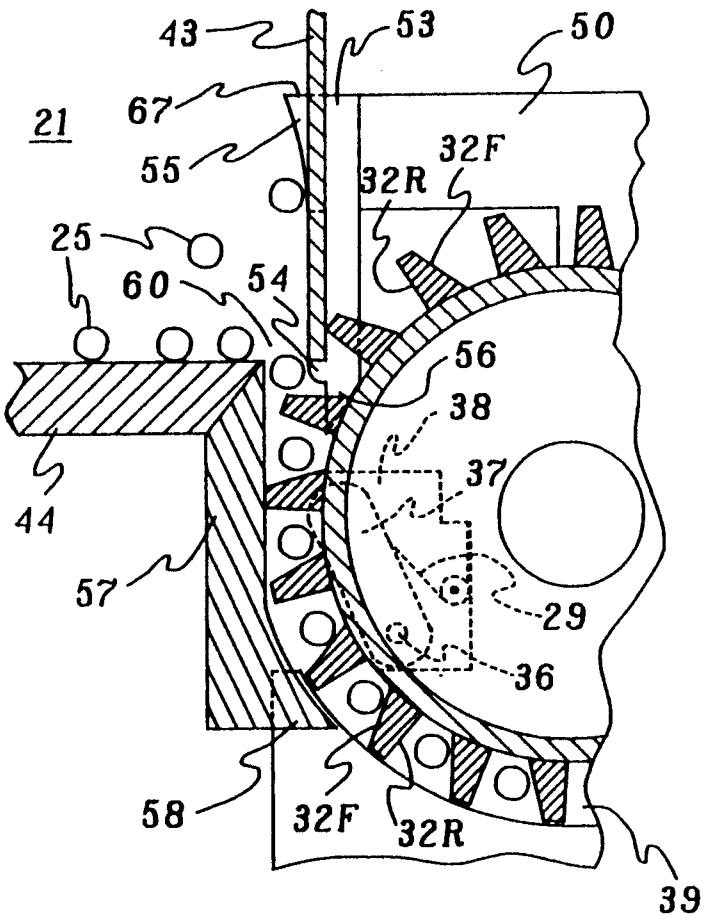
FIG. 2A is a cross-sectional view of a portion of the invention taken in the direction of the arrows on line 2—2 of FIG. 1 depicting the elevator plate in the upper position with a partially filled collection chamber.
Figure 4:
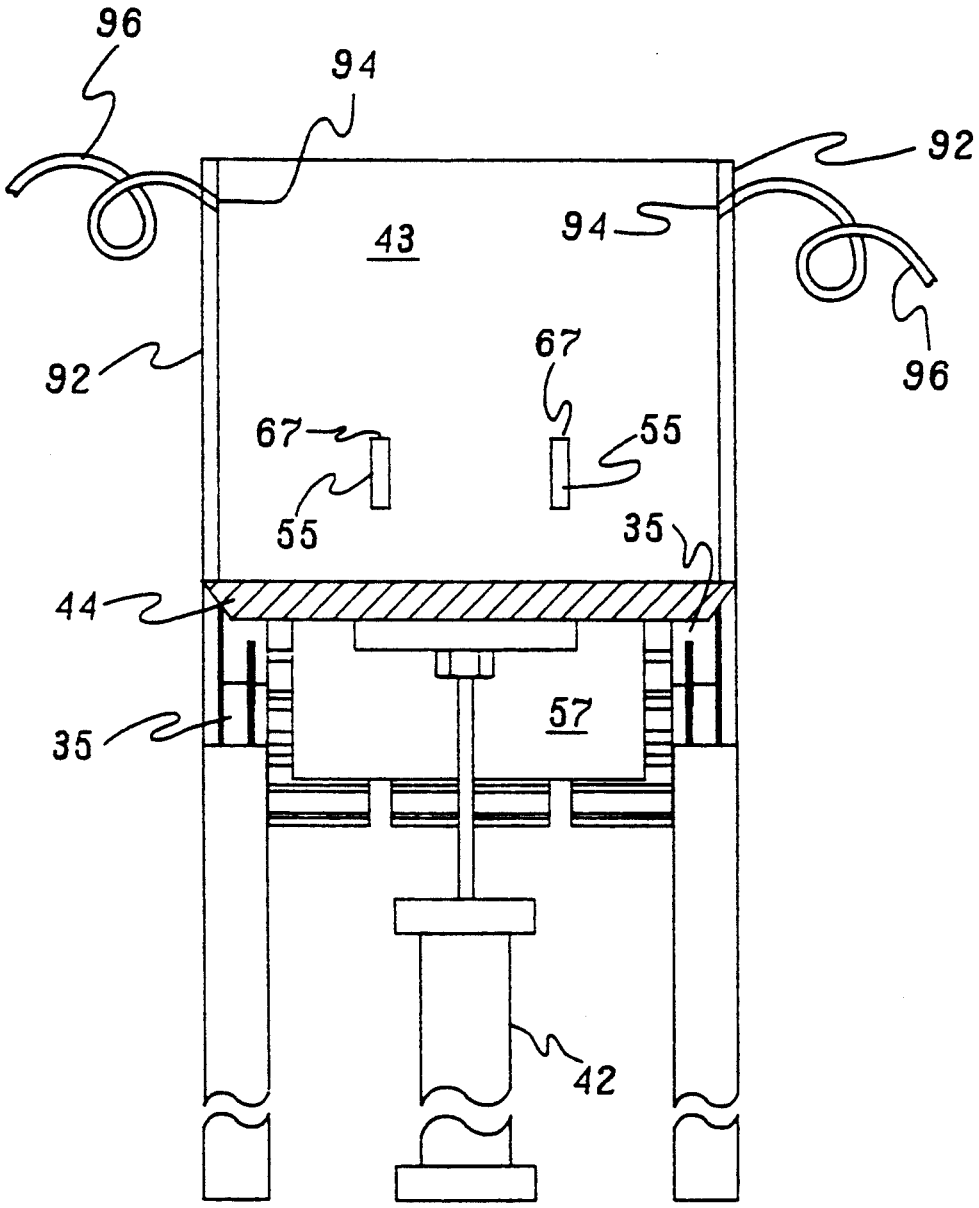
FIG. 4 is a cross-sectional view of a portion of the invention taken in the direction of the arrows on line 4—4 of FIG. 2A with the straws removed.

FIGS. 2A, 2B and 2C provide an elevated view of a portion of the invention along line 2—2 of FIG. 1. The drum 31 is located adjacent to the collection chamber 21. The opening between drum 31 and collection chamber 21 varies from a large opening as depicted in FIG. 2B and 2C, in which a significant portion of the drum 31 is exposed to the collection chamber 21, to a high narrow slot 60 located near the top of the drum 31, as depicted in FIG. 2A. In FIG. 2A the elevator plate 44 is located in the upper position and downward projecting skirt 57 of elevator plate 44 covers up most of the opening between the drum 31 and collection chamber 21. The high narrow slot 60 is formed by the top edge of the elevator plate 44 and the adjacent bottom edge of compression plate 43. FIG. 4 provides a front elevated view along line 4—4 of FIG. 2A. An overhead view of slot 60 appears in FIG. 1.

FIG. 2A depicts the invention at the first step of its cycle. In FIG. 2A, the elevator plate 44, which forms the bottom of collection chamber 21, is at its upper position. Straws 25 are being discharged from the drum through slot 60 onto elevator plate 44. Compression plate 43 is in its retracted position. Once a predetermined number of straws have been discharged from the drum 31 into chamber 21 the straws are then moved to loading chamber 23. Compression plate 43 moves the straws to loading chamber 23 when hydraulic cylinder 41, to which it is attached, drives plate 43 across collection chamber 21 over plate 44 to loading chamber 23. Compression plate 43 thus pushes the straws out of collection chamber 21 and into loading chamber 23. As noted above, counter 71 FIGS. 2A, 2B and 2C counts the wrapped straws 25 deposited from drum 31 into collection chamber 21. Counter 71 counts the straws 25 on the drum 31 as they pass counter 71 on their way to collection chamber 21.

As depicted in FIG. 2B, compression plate 43 remains in its extended position to form a side of the loading chamber 23 while elevator plate 44 drops to its lower position to continue to receive straws being discharged from drum 31 in an uninterrupted stream. While compression plate 43 remains in its extended position forming a side of loading chamber 23 box loading plate 46, FIG. 1, is driven by hydraulic cylinder 45 across chamber 23. This movement of loading plate 46 inserts the straws now located in loading chamber 23 into a formed empty box on the side of loading chamber 23 opposite loading plate 46.

Once the straws are loaded into a box by loading plate 46, compression plate 43, as depicted in FIG. 2C, is withdrawn across the collection chamber 21 to its retracted position above the drum 31. Once compression plate 43 is fully retracted then elevator plate 44, with straws deposited in the interim thereon from drum 31, moves back to its upper position, as illustrated in FIG. 2A, and the process repeats itself.

Referring to FIG. 2A, as the straws are conveyed around the drum 31 by the vanes 32 they are counted by an optical counting device 71.

FIG. 5A is an elevated, exploded view of the drum 31, its side support structure or plates 35L and 35R, combined stripper fingers and cams 53 and stripper finger support bar 50. The drum has axles 52 which project into the support plates 35L and 35R. The axles provide support and are connected to an appropriate mechanism, not shown, to rotate the drum.

The straws 25, as can be seen from FIG. 5A, are longer than the drum 31 is wide. The ends of the wrapped straws 25 project from either end of the drum into an annular or circular groove 39, which grooves are depicted in FIGS. 5B and 5C. FIG. 5B is a side view of the support plate 35R on the right hand side of FIG. 5A. FIG. 5C is a side view of support plate 35L the left hand side of FIG. 5A. Plates 35L and 35R are similar to each other except that upper portion 59 of plate 35L is enlarged so as to form a backstop opposite accelerator 61 where inserted straws 25 will strike it. As the drum rotates and the front of the vanes push the wrapped straws 25, the ends of each wrapped straw 25 project into the annular grooves 39 on plates 35R and 35L. Consequently, the straws 25 are moved by the vanes 32 around the entire distance of both grooves 39 unobstructed. At the end of the annular grooves 39, the straws are rotationally positioned by the drum 31 and vanes 32 to be discharged into collection chamber 21. In fact, grooves 39 on both plates 35L and 35R in the preferred embodiment provide support for straws 25 and prevent the straws 25 from falling off the drum as they are conveyed around by vanes 32 of drum 31 to chamber 21. An alternative method for holding the straws on the drum would be placement of sheeting around the bottom of the drum.

Each vane 32 is divided into three sections by notches 34. The notches 34, in effect, form passages 40, which provide an unimpeded path around the drum 31 through the vanes 32 for the lower end 56 of the stripper fingers 53, FIG. 5A and 5D. FIG. 2A-1 and 2B-1 provide a profile view of how the lower end 56 of the stripper fingers 53 extends down into passages 40. The stripper finger is shaped to easily fit through notches 34. Support bar 50 holds the stripper fingers in a position next to the drum adjacent to the opening into the collection chamber 21. The stripper fingers 53 urge the straws 25 off of drum 31 through the opening into the collection chamber 24. The stripper fingers 53 and their function will be described in more detail below.

Figure 3:
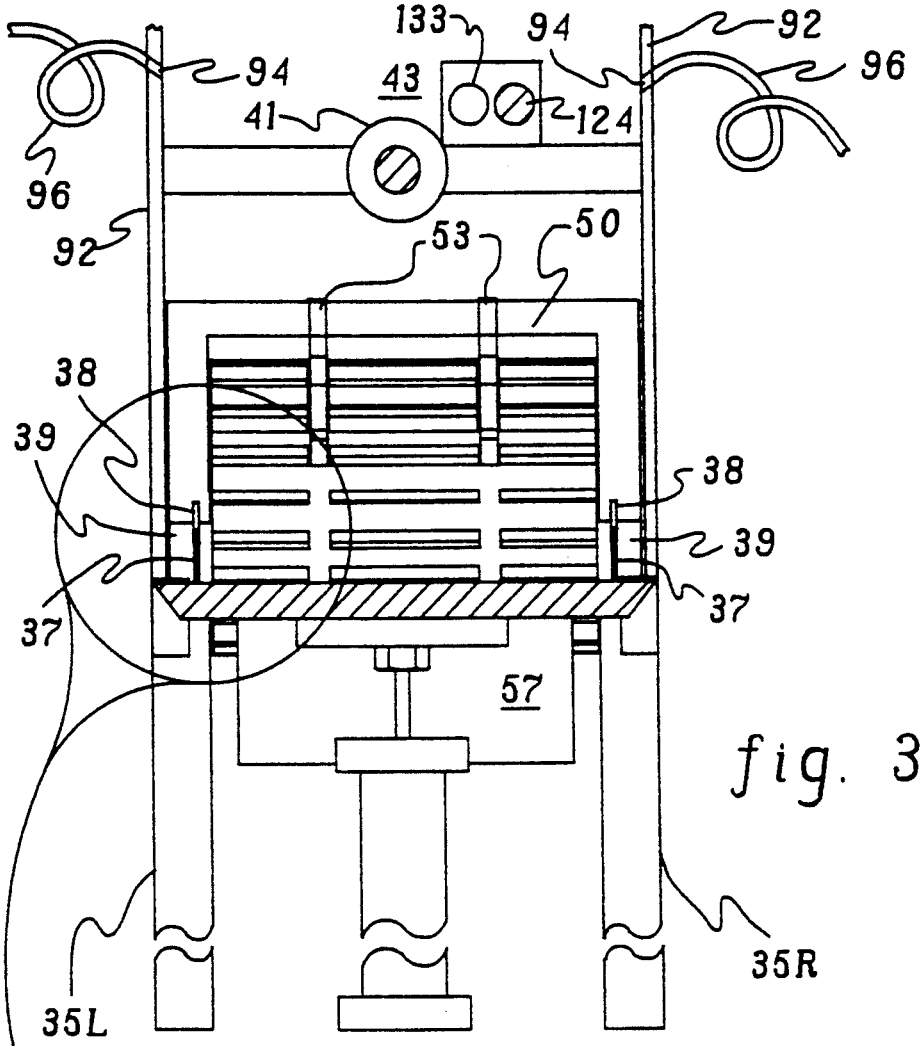
FIG. 3 is across-sectional view of a portion of the invention taken in the direction of the arrows on line 3—3 of FIG. 2B with the straws removed.
Figure 3A:
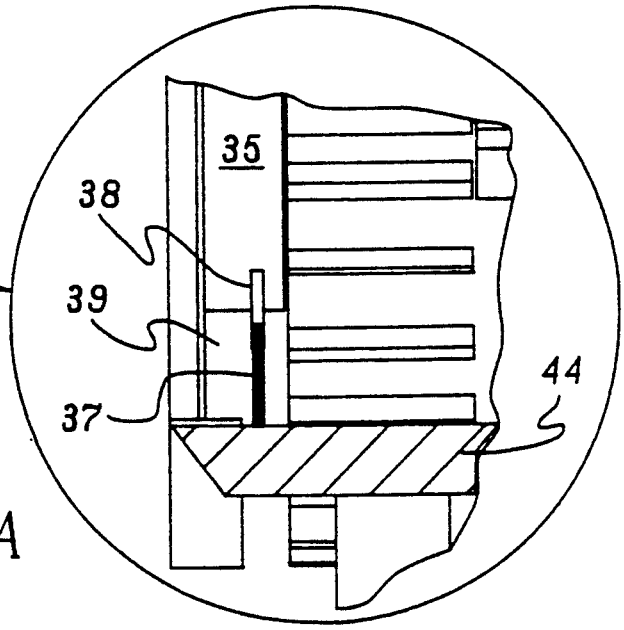
FIG. 3A is an enlarged view of the encircled area of FIG. 3.

The present invention has specific mechanisms to assure that straws are discharged from the drum 31 and out of the annular grooves 39 into collection chamber 21 when the elevator plate 44 is in its lower position. FIG. 3, a depiction of the elevator plate 44 at its lower position, is an elevated view along line 3—3 of FIG. 2B. Two pivotally mounted discharge bars 37 help to discharge the straws or elongated objects into the collection chamber 21 when the elevator plate 44 is in its lower position. The two pivotally mounted discharge bars 37 are situated on each side of the drum where the annular grooves 39 meet the elevator plate 44, as depicted in FIG. 3. The recess 38 into which the discharge bars 37 can be retracted are located in both support plates 35L and 35R just above the position at which the annular grooves 39 meet chamber 21. See also FIGS. 5B and 5C. FIG. 3A is an enlarged view of one of the discharge bars 37 and the recess 38 located in the side support plate 35L. As noted, the recess 38 into which the discharge bar 37 can be retracted is directly above the spot where the annular groove 39 terminates at the edge of chamber 21.

FIG. 2B-1, an enlarged mirrored view of a portion of FIG. 2B, depicts the discharge bar 37, its pivot at point 36 and recess 38. When plate 44 is in its lower position discharge bar 37 falls out of recess 38 onto annular groove 39. Spring 29 pushes discharge bar 37 out of recess 38. Bar 37 contacts the wrapped straws 25 as they come up out of groove 39 and urges them onto elevator plate 44 in chamber 21. Static electricity, a problem encountered with light cylindrical objects such as wrapped straws, tends to make the straws adhere to the drum and vanes. Although appropriate electrical circuitry can be added to ground all the metal and remove a substantial portion of the static electricity, there is still a tendency for residual static electricity to cause the wrapped straws to adhere to the drum and vanes. Thus, bar 37 causes any wrapped straw 25 sticking to the drum or vane to be disengaged from the vanes and drum and directed or urged into collection chamber 21 onto the top of elevator plate 44.

The angled front surfaces 32F of the vanes 32, as depicted in FIGS. 2A-1 and 2B-1, also assist in discharging the straws into collection chamber 21 when the straws are rotationally positioned at the opening between the drum 31 and collection chamber 21. As can be seen, the front surface 32F of each vane, which push the straws are at an angle to the normal of the arc of the drum 31. The rear surface 32R of each vane 32 by contrast is on the normal to the arc of the drum 31. The angle of inclination of the front surface 32F of each vane is such that it would intersect the normal rear surface 32R of that vane if both were extended up away from the surface of the drum 31. By angling the front surface 32F of the vane 32, straws can more easily roll off the vanes 32 as they are discharged into collection chamber 21.

FIG. 3 depicts air hoses 96 which penetrate side covers 92 of the collection chamber 21. Side covers 92 can be made of plexiglass or clear plastic. Air hoses 96 inject air into the collection chamber 21 while compression plate 43 is fully extended. The purpose of injecting air through hoses 96 is to blow any straws which may adhere to the upper part of the drum 31 and vanes down into the chamber onto elevator plate 44. As noted above, static electricity causes the straws to adhere to the vanes and the drum, thus the air injected by the air hose 90 counteracts this. The connections 94 of the air hoses 96 through sides 92 point down towards the drum 31 and elevator plate 44 to blow any straws on the drum down onto elevator plate 44 while in its lower position.

FIG. 4 is a front elevated view along line 4—4 of FIG. 2A without the straws. Cams 55 of stripper fingers 53 project through opening 67 in compression plate 43. A stripper finger 53 is depicted in profile in FIG. 5D.

Stripper finger 53 is composed of cam 55, a lobe 54 and a bottom end 56.

FIG. 2A-1 is an enlarged mirrored view of a portion of FIG. 2A. As can be seen in FIG. 2A-1, stripper finger 53, which is supported by a bar 50, projects down below the level of elevator plate 44. Specifically, lower end 56 of stripper finger 53 projects down into the passage 40 through the notches 34 on each vane of the drum. The notches 34 are also depicted on FIG. 5A. Referring to FIG. 2A-1, the stripper fingers 53, specifically their lower ends 56, urge or direct an elongated object or straw located in front of the vanes 32 off the drum into chamber 21 when elevator plate 44 is in its upper position. The lower end 56 of the stripper finger 53 obviously prevents any straws from proceeding on with the drum 31 past the location of the stripper finger. Lobe 54 of the stripper finger 53 in FIG. 2A-1, as can be seen, terminates at the top level of elevator plate 44. Lobe 54 prevents the straws from becoming caught on the flat surface at the bottom of compression plate 43 and helps discharge the straws into chamber 21.

Cam 55 of the stripper finger 53, as noted above, projects through opening 67 of plate 43 into chamber 21. As the straws are brought around by the vanes 32, static electricity tends to cause the straws to adhere to the metal surfaces. The straws, in fact, have a tendency to creep up along compression plate 43. Thus cam 55 helps direct the straws away from compression plate 43 into chamber 21 onto plate 44. Both lobe 54 and cam 55 reduce the surface contact area of the straw with compression plate 43 to only the narrow surface of the lobe 54 and then the cam 55, respectively; this reduces the surface of the straw affected by static electricity allowing the straws to be discharged or fall into chamber 21 under its own weight.

Downward projecting skirt 57 FIG. 3B extends from the edge of elevator plate 44 which is adjacent to the drum down perpendicular to the top surface of elevator plate 44. At the bottom of downward projecting skirt 57 is a curved lip 58. When plate 44 is raised to its upper position, as depicted in FIG. 2A-1, the lip 58 is adjacent to the drum 31 and provides a guide to guide the straws up towards the top of plate 44 and thus prevents the straws 25 from falling off the drum 31 below plate 44. Lip 58 continues the arc of the annular grooves 39 up to the top of elevator plate 44. As illustrated in FIG. 2A-1, since the curved lip 58 continues the channelling effect of annular grooves 39, the straws are directed up to opening 60 and push discharge bar 37 back out of the way.

4. The Box Assembler

Figure 9:
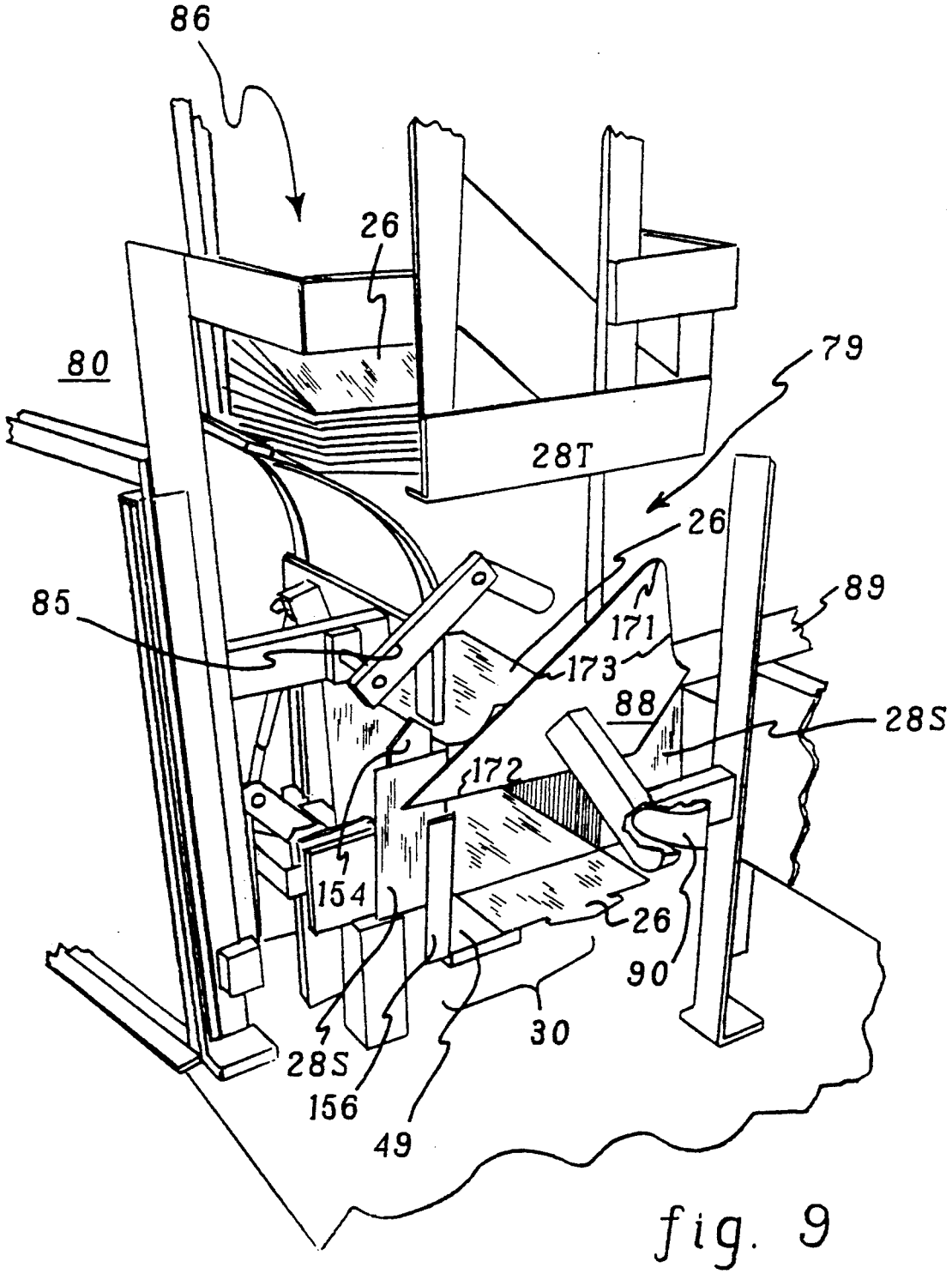
FIG. 9 is a perspective view of the box assembler in which a box is fully assembled and rests in the box shuttle.

FIG. 9 is a perspective view of the box assembler 80. At the top is the box receiver 86 which holds flat folded boxes 26. Below box receiver 86 is the box erection chamber 79 which contains a forming box 26 traveling through chamber 79. At the bottom of the box erection chamber 79 is box shuttle station 30 at which a box shuttle 49 is ready to receive a fully formed box 26. Shuttle station 30 is simply the bottom portion of box assembler 80 where shuttle 49 is positioned to receive an erected box 26.

At the front of the erection chamber 79 is inclined spreading board 88 which spreads the top and side flaps of the box. Curved guide rails 87 run from a bottom edge of the box receiver 86 downwardly and inwardly towards the center of chamber 79 and help form the box 26. Referring to FIG. 1, as previously noted, the fully erected boxes after assembly by the box assembler 80, are moved by shuttle 49 to box loading station 51 to be filled with straws located in the loading chamber 23.

Figures 1, 6A, 6B, 6C, 6D:
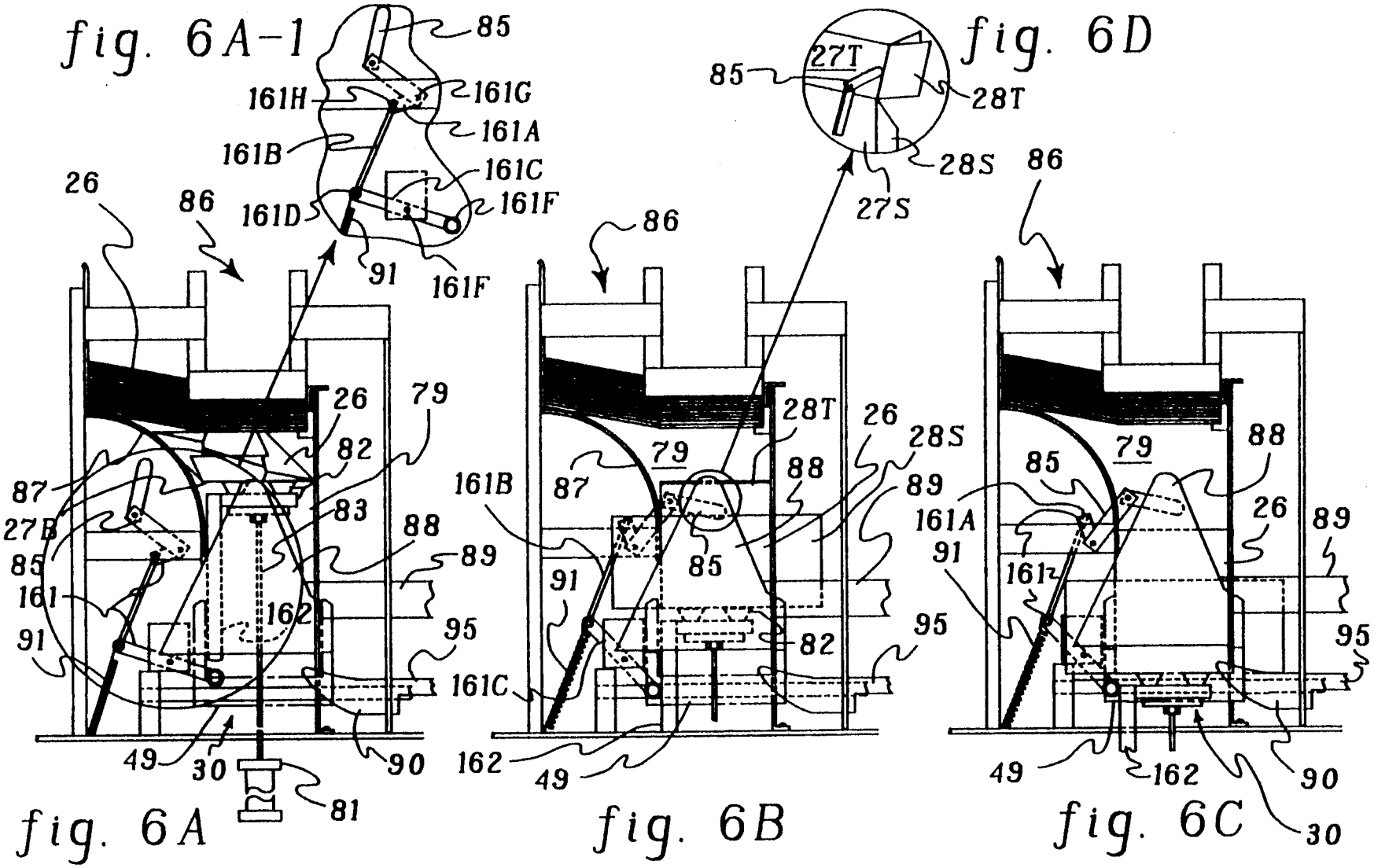
FIG. 6A is a front elevation of the box assembler with a flat folded box being drawn out of the receiver at the beginning of the box assembly cycle.
FIG. 6B is a front elevation of the box assembler with a box partway through the erection process.
FIG. 6C is a front elevation of the box assembler with a fully assembled box resting in the box shuttle.
FIG. 6D is a perspective view of the encircled portion of FIG. 6B.
Figures 1, 6B:
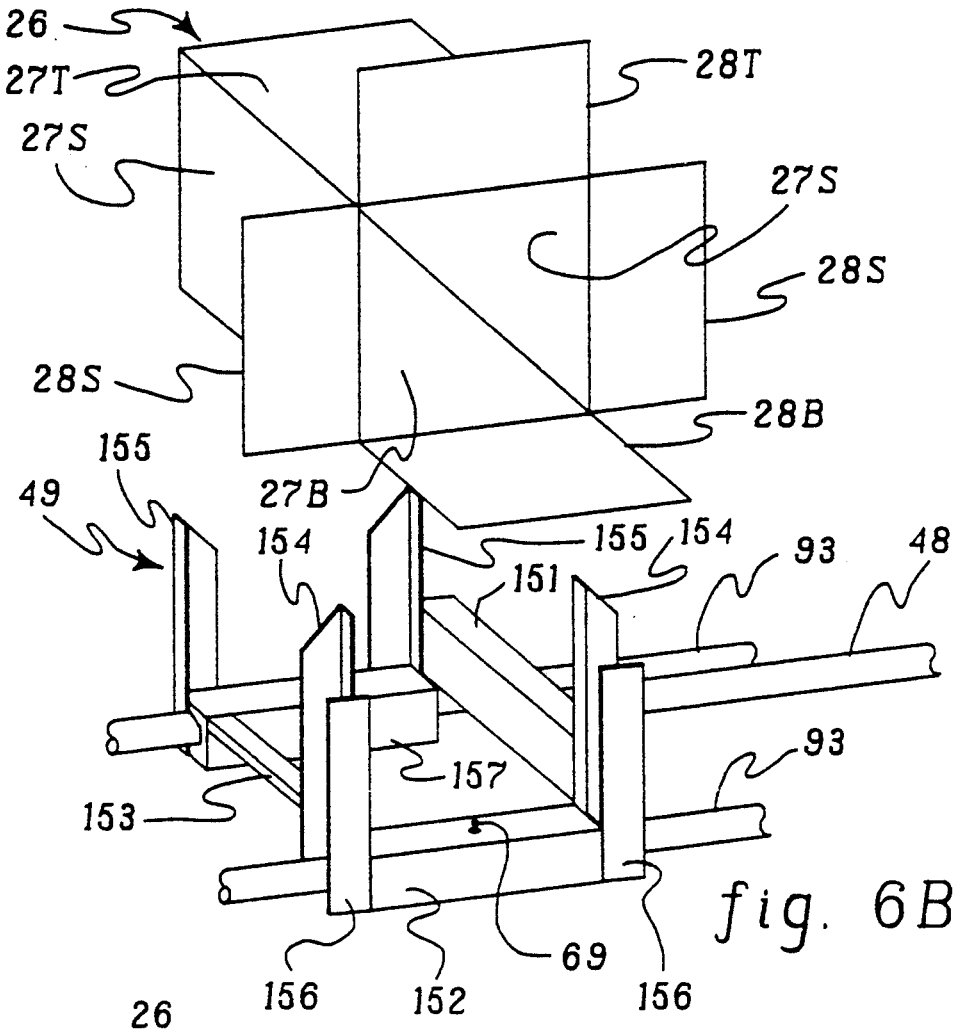
Figures 1, 6C:
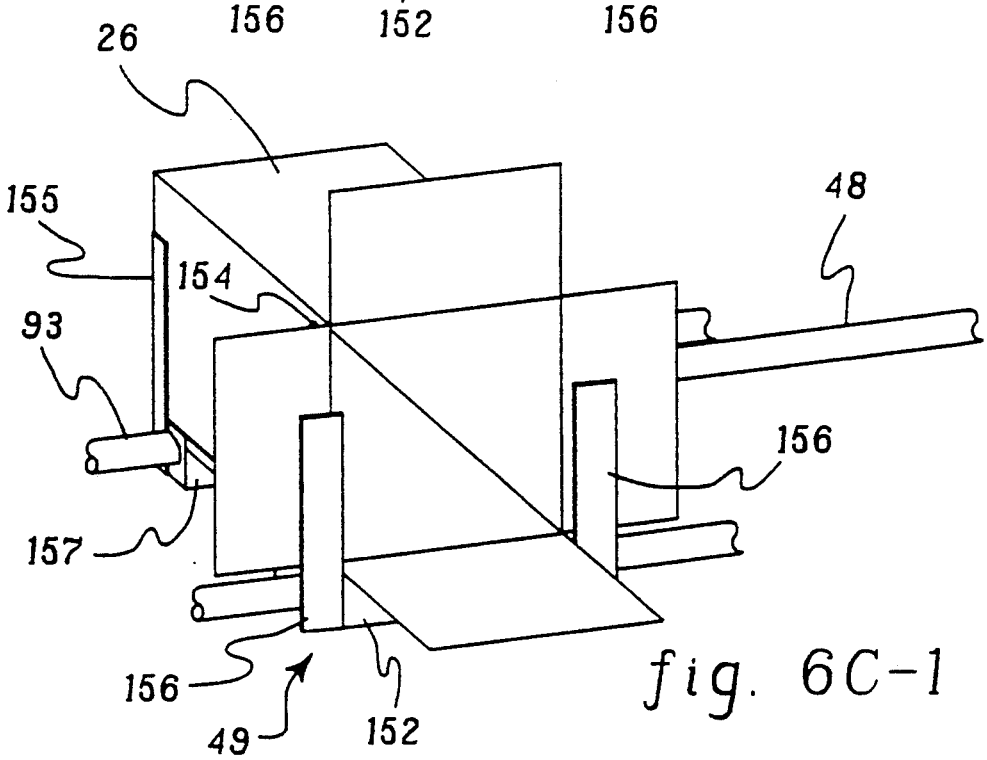

The boxes used in the preferred embodiment are, in general, specially made to hold wrapped straws or other light cylindrical objects. FIG. 6A depicts one such box 26. The four panels of the box are identified as the top panel 27T, the bottom panel 27B and the two side panels 27S. The box has a closed end (not visible in FIG. 6A) with flaps which automatically interleave when the box is erected. Boxes of the type described herein are well-known in the art. The manufacturer cuts the box shape out during the manufacturing process. To cut down on bulk during shipping the boxes are folded flat with the formed side panels attached end to end and lying in the same plane so the boxes can be easily stacked and transported. The flat folded boxes are depicted in box receiver 86, FIGS. 7, 6A, 6B and 6C.

The open end of the box depicted in FIG. 6B-1 is the end through which the straws or long cylindrical objects are loaded. Each flap at the open end of this box is identified according to the panel to which it is attached. Top flap 28T is attached to panel 27T. The side flaps 28S are each attached to one of the two side panels 27S and the bottom flap 28B is attached to the bottom panel 27B. The panels and flaps have been designated to assist in the description of the assembly of the box and references to bottom, top and sides merely give an indication of the box's orientation when assembled and ready to be filled.

FIGS. 6A through 6C depicts, in sequence, how the box assembler 80 works. FIGS. 6A through 6C are elevated views of the box assembler along line 6—6 of FIG. 1. Folded and unformed boxes are located in box receiver 86 located above box erection chamber 79, as depicted in FIG. 6A. Also depicted in 6A is a compression cylinder 81 from which a shaft 83 extends. Shaft 83 has a suction cup assembly 82 located at one end. Although not shown, the suction cup assembly 82 is connected to a suction source through appropriate valves and lines for controllable operation. Such arrangements are assumed to be familiar to those skilled in the art.

In the initial step of the erection process, cylinder 81 is activated and extends shaft 83 up through the erection chamber 79 until the suction cup assembly 82 makes contact with the bottom panel 27B of the box located at the bottom of the box receiver 86. The suction cups on the suction cup assembly then secure themselves to panel 27B of the bottom box 26 facing into the chamber 79 and commence pulling this bottom panel 27B down through chamber 79 in a horizontal orientation, as depicted in FIG. 6A. As the box is being drawn down by its bottom panel 27B, guide rails 87 force the left side panel (as viewed in FIG. 6A) into a substantially perpendicular position with the bottom panel 27B. This action causes the top panel 27T and the right side panel 27S to assume their familiar positions as the box opens, as shown in FIGS. 6A and 6B.

Figure 8:
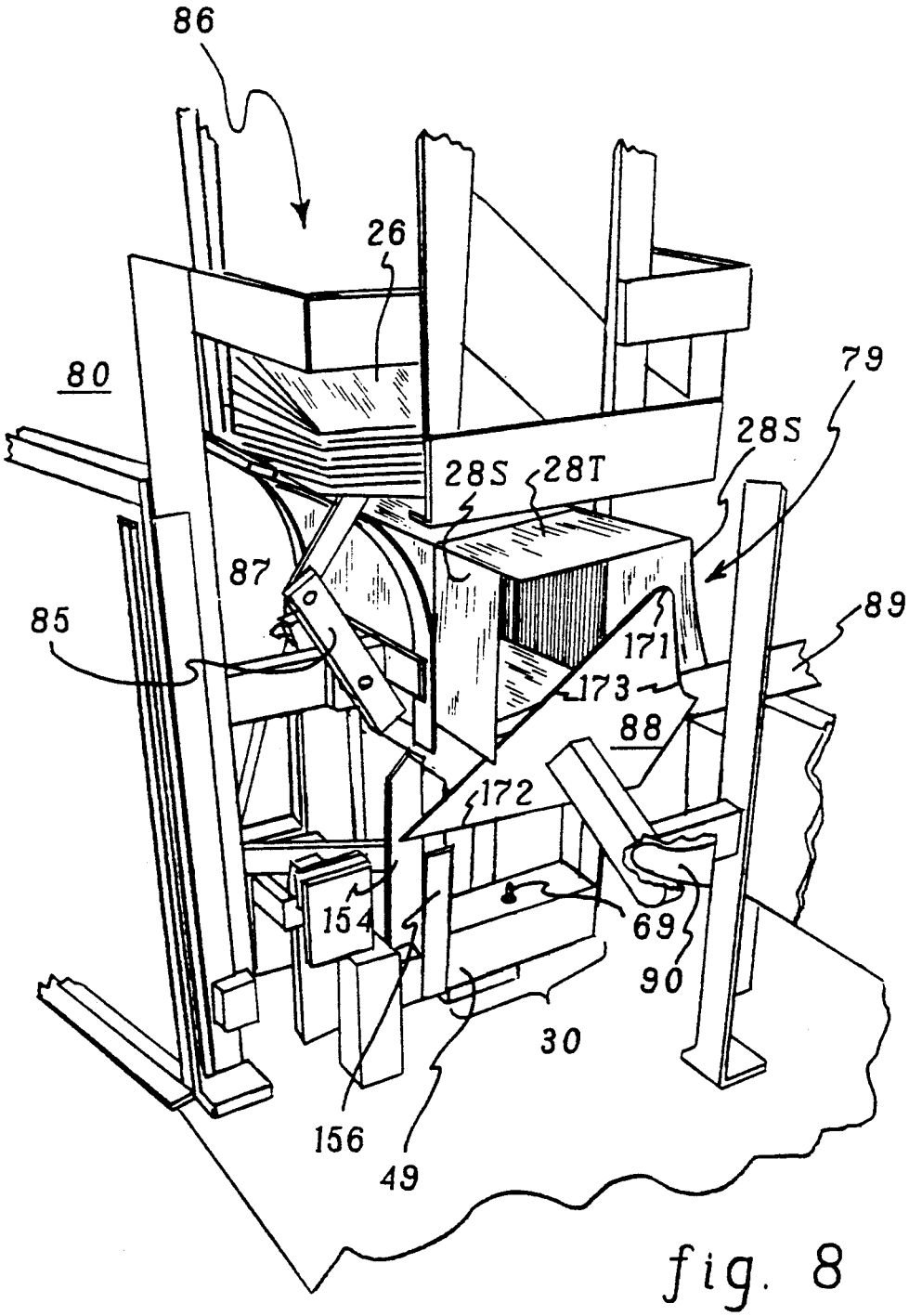
FIG. 8 is a perspective view of the box assembler in which a box is partway through the assembly process.

FIG. 6B depicts the box 26 partway through the erection process. The suction cup assembly has gone partway down through the erection chamber 79. The box's side panels 27S are perpendicular to the top panel 27T and the bottom panel 27B. The flaps 28 are substantially parted. FIG. 6B-1 corresponds to FIG. 6B and depicts the orientation of the box in relation to the shuttle at this point in the sequence without the surrounding support structure. FIG. 8 depicts the box in the position roughly between its position in FIGS. 6A and 6B where an inclined spreading board 88, located in the path of the flaps between box receiver 86 and shuttle station 30, is starting to spread the flaps. The inclined spreading board 88 will be discussed at length below.

FIG. 6C depicts the box 26 after it has been fully erected and its side panels 27S are perpendicular to the top panel 27T and the bottom panel 27B. The box in FIG. 6C rests in the shuttle 49 at shuttle station 30. FIG. 6C-1 depicts how the box would appear in the shuttle without the surrounding support structure obscuring it. FIG. 9 is a perspective view of the box assembler with the fully formed box sitting in the shuttle 49 while the shuttle is at shuttle station 30 at the bottom of erection chamber 79.

Once the box has been formed and rests in the shuttle 49, it is then conveyed from the shuttle station 30 to box loading station 51. Referring to FIG. 7, the suction cup assembly 82 releases from panel 27B of the formed box when the air suction system shuts off. Shaft 48, which is attached to the shuttle 49, is retracted by hydraulic cylinder 47 which draws the shuttle 49 from the shuttle station 30 to the box loading station 51. Upon the shuttle's reaching box loading station 51, movement of the shuttle ceases when the hydraulic cylinder 47 shuts off.

The shuttle rides along rails 93, FIG. 1, which run from the shuttle station 30 at the box assembler 80 to the box load position 51. FIGS. 6B-1 and 6C-1 depict the shuttle and a portion of the rails 93 on which the shuttle 49 rides. The frame construction of the shuttle 49, its construction in the preferred embodiment, allows the shuttle 49 to securely hold an assembled box on its side with on open end being in a preferred direction with the side flaps 28S held in a spread position to the side of the open end as depicted in FIG. 6C-1. The shuttle is composed of a front shuttle slide 152 and a rear shuttle slide 157. In the preferred embodiment, the shuttle slides 152 and 157 are made of aluminum or some other material that is easily fabricated into various shapes. A round opening can be formed through both shuttle slides. The rails 93 run through the openings in the shuttle slides 152 and 157. The shuttle slides 152 and 157 are connected to each other by a shuttle frame bar 153 and a shuttle pull bar 151. Box shuttle shaft 48, in the preferred embodiment, connects to the center of shuttle pull bar 151 and pushes or pulls the shuttle at this point. The outside ends of rear shuttle slide bar 157 at the back of the shuttle each have a rear box restraint 155 which holds the closed end of box 26. The front slide bar 152 of the shuttle and its two inside ends each have a front box restraint 154. A side flap restraint 156 is located opposite each front box restraint 154, on the opposite side of the front shuttle slide bar 152. As can be seen in FIG. 6C-1, the rear box restraints 155 hold the rear of a fully formed box 26 when it sits in the shuttle. Each front box restraint 154, together with a paired side flap restraint 156, holds the front of the box 26 and the two side flaps 28S in a spread position when the box 26 rests in the shuttle 49. The automatic positioning and holding of the flaps of an erected box is one of the problems which the present invention solves in providing fully formed boxes positioned to be filled with objects.

An inclined spreading plate or board 88, FIG. 8, is the mechanism which inserts the side flaps 28S into position between each paired front box restraint 154 and the side flap restraint 156. The inclined spreader board, depicted in a perspective view in FIGS. 8 and 9, is in the path of the flaps between box receiver 86 and shuttle station 30 and spreads the side flaps 28S as the box is being drawn down through the erection chamber 79. FIG. 8 shows the flaps 28S just starting to touch the inclined spreading board 88. FIG. 9 shows the box positioned in the shuttle 49. As can be seen from FIGS. 8 and 9, the inclined spreading board 88 in the preferred embodiment, is roughly triangular in shape with a base 172 at the bottom and a vertice 171 at the top. The board 88 is inclined downwardly and inwardly towards the center of the erection chamber 79. As illustrated in FIGS. 8 and 9, the bottom base 172 of the inclined spreading board 88 terminates at a position just above the top ends of the side flap restraints 156. Thus, the side edges 173 of inclined spreader sheet 88 push or spread the side flaps 28S out to the side and then direct each side flap 28S to a position between a paired side flap restraint 156 and a front box restraint 154.

The inclined spreading board 88 also serves to spread and push flap 28T backwardly and upwardly into a fully opened position. Once flap 28T is so positioned, it is held back by guide rail 89, depicted in FIG. 9A. Guide rail 89 is also depicted in FIG. 6C as well as FIG. 7 and holds top flap 28T back in an opened or spread position, as the shuttle 49 moves from the shuttle station 30 to the box load position 51.

One of the problems encountered in forming the box is that if top panel 27T starts to buckle during the opening process, then its attached flap 28T will also buckle. If this occurs, the top of the box will have a tendency to crumple and the box will not properly form. Finger 85 is the mechanism which assures that flap 28T bends properly at its hinged joint with panel 27T as the box is being drawn down through the erection chamber 79. Finger 85 is operable between a retracted position as depicted in FIG. 6A to an advanced position, as depicted in 6B. A lever arm mechanism 161 working in conjunction with spring 91 and downward projecting rigid member 162 of the suction cup assembly 82 cause the finger 85 to move from its retracted to its advanced position. The lever arm mechanism 161 attaches by a crank 161A at one end to the finger 85. Referring to FIG. 6A-1, the lever arm has three parts, a crank 161A, a middle arm 161B and a lower arm 161C. The crank 161A is attached to the middle arm 161B at joint 161H and the middle lever arm 161B is attached to lower lever arm 161C at joint 161D. Crank 161A attaches to the finger at pivot point 161G. Lower lever arm 161C attaches at a pivot point 161E in its mid-section. The end 161F of lower lever arm 161C projects into the path of the downward projecting member 162 of the suction cup assembly 82 in chamber 79.

As depicted in FIG. 6A when the suction cup assembly 82 is at the top of erection chamber 79 the finger 85 is in its fully retracted position. Spring 91 which is attached to a joint 161D of the lever arm mechanism 161 and to a bottom corner of erection chamber 79 pulls joint 161D and, thus lever arm mechanism 161, back. The action of spring 91 causes end 161F of the lower lever arm 161C to project into the path of downward projecting member 162 of the suction cup assembly 82. As the suction cup assembly 82 moves down through the erection chamber 79, pulling a box 26 with it, downward projecting member 162 hits the end 161F of the lower lever arm 161C and pushes it back out of the way, as depicted in FIG. 6B. Lower end 161F of lower arm 161C has a wheel on it to make it easier for downward projecting member 162 to push it out of the way. As depicted in FIG. 6B, lower arm 161C pivots at point 161E and pushes middle arm 161B up which, in turn, pushes the crank 161A up. Crank 161A then rotates finger 85 to its advanced position. On moving to its advanced position, as depicted in FIG. 6B, finger 85 makes contact at the hinge where top panel 27T meets top flap 28T as depicted in FIG. 6D. At the same time finger 85 is pushing on the hinge between flap 28T and panel 27T the flap 28T is hitting inclined spreading board 88 and is being turned up. Finger 85, in conjunction with the action of inclined spreading board 88, thus causes the hinge between panel 27T and flaps 28T to bend in the normal fashion. Consequently, flap 28T bends up properly it comes in contact with the inclined spreading board 88 and panel 27T assumes a flat plane shape and does not buckle.

Before the shuttle 49 moves a fully formed box 26 from shuttle station 30 to the load position 51, the bottom flap 28B, is set in a substantially straight position in the same horizontal plane with bottom panel 27B. Then when the shuttle 49 moves, bottom flap 28B is engaged by the bottom surface of curved guide 90, depicted in FIG. 9B Curve guide 90 pushes bottom flap 28B down and out of the way. Curve guide 90 is attached to bottom guide rail 95 which runs from the termination of curve guide 90 to the box load position 51, FIG. 1. Guide rail 95 depicted in FIG. 7 keeps bottom flap 28B spread down out of the way so that it does not interfere with movement of the shuttle 49 or loading of the box 26 at position 51.

To assure that bottom flap 28B is in a straight orientation in substantially the same horizontal plan as panel 27B, pin 69, depicted in FIG. 9A contacts bottom panel 27B when the formed box 26 comes to rest in the shuttle 49 causing a slight indentation and upward bend in panel 27B which effectively straightens flap 28B. The effect of the pin 69 is to put flap 28B in a straight or horizontal position ready to contact the bottom surface of curve guide 90 as the shuttle 49 moves from the shuttle station 30 to the box loading area 51.

As the shuttle 49 moves the fully formed box 26 to position 51 the side flaps 28S, as previously noted, are held back in position by the shuttle structure itself. The top flap 28T is restrained by the top guide rail 89 which runs from the side of inclined spreading board 88 at chamber 79 to loading position 51. Lower flap 28B is held back and spread by lower guide rail 95 which runs from the shuttle station 30 to the load position in chamber 51.

Figure 7A:
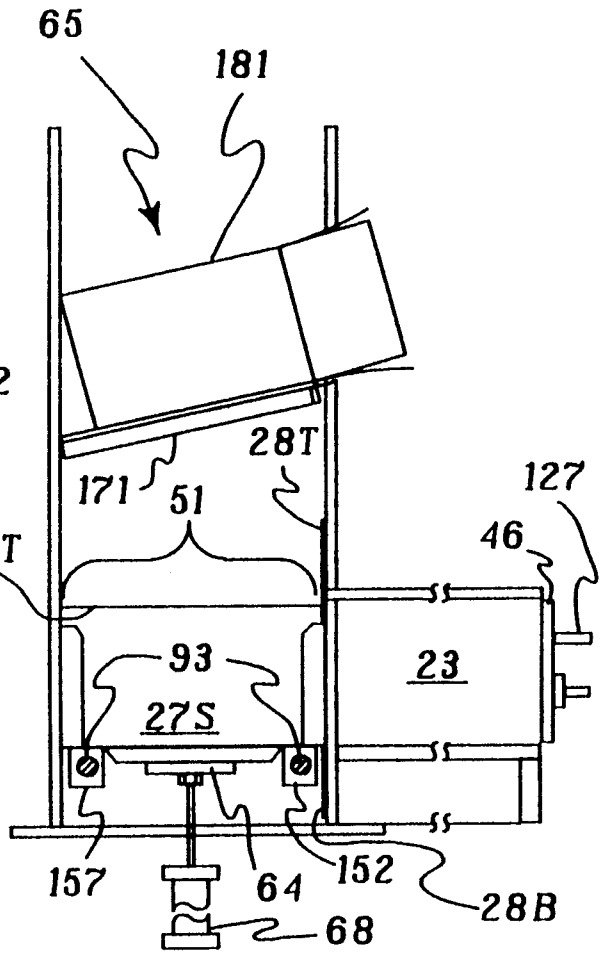
FIG. 7A is a left side elevation of the box loading and holding structures with the shuttle slide rails shown in cross-section.
Figure 7:
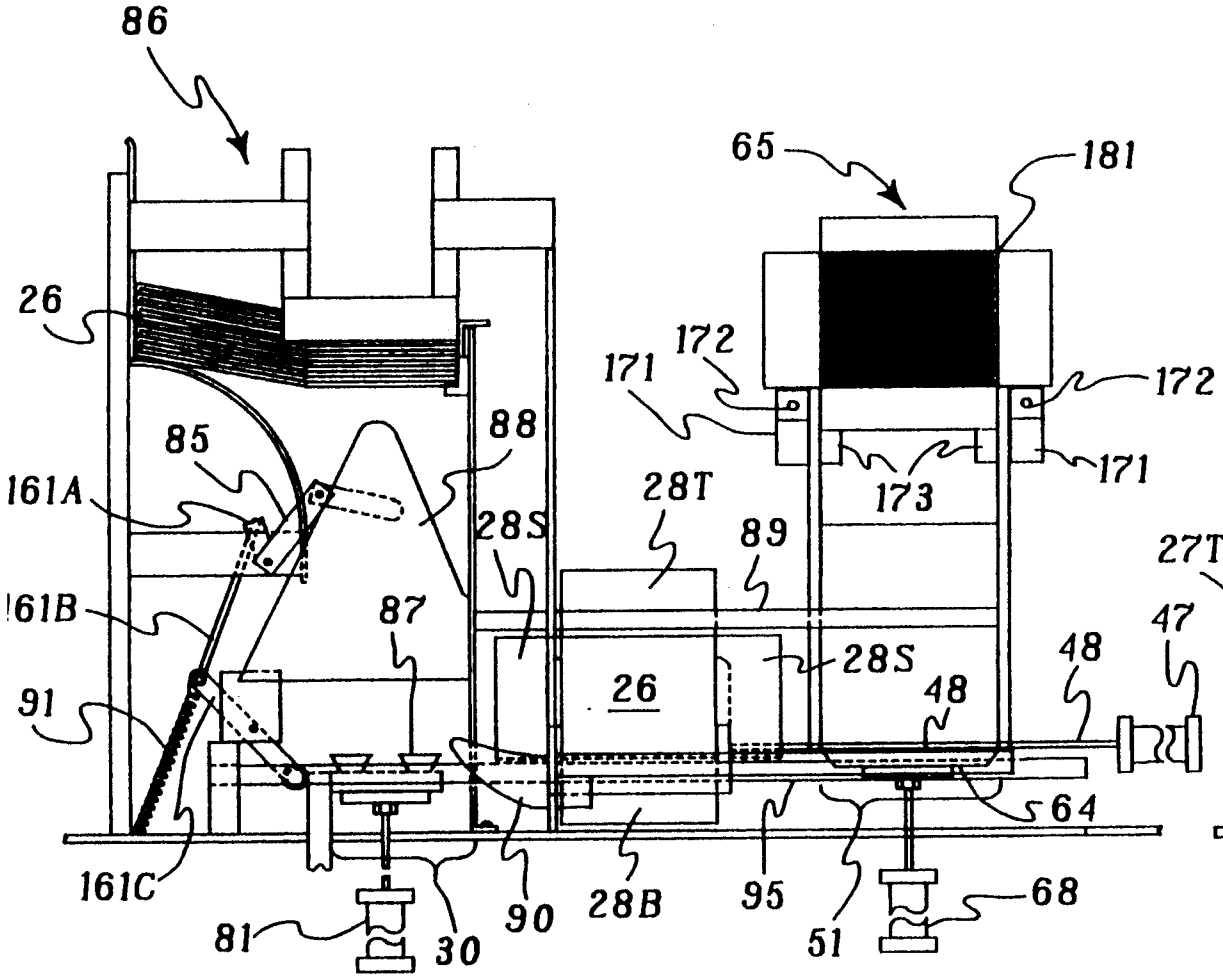
FIG. 7 is a front elevation of the box assembler and adjacent box loading and full box holding structure.

As shuttle 49 reaches box loading station 51 FIG. 7A, the box 26 is positioned such that its open end faces into loading chamber 23. At this time, the loading plate 46 is located in its fully retracted position. Loading chamber 23 is provided with a pair of centering plates 70, as depicted in FIG. 2C and 2A. When loading plate 46 (see FIGS. 1 and 7A) is extended across loading chamber 23 and pushes the straws towards the open end of box 26, the ends of the straws first contact the centering plates 70 (see FIG. 2D) which are hinged at their ends to the top and bottom of the loading chamber 23. Centering plates 70 then swing in and contact both the top and bottom surface of the box 26 and thus centering the box 26 as depicted in FIG. 2D. The straws then move into box 26 past the centering plates 70 which they have pushed aside, as depicted in FIG. 2D.

Referring to FIGS. 7 and 7A, once the box has been filled with straws 25 at position 51, then compression cylinder 68 (see FIG. 7A) extends and pushes lift plate 64 upwardly, thereby lifting the full box 181 off of the shuttle 49 and up to holding area 65. Shuttle 49 has an open center large enough to allow lift plate 64 to pass unimpeded. As the full box 181 is being pushed up towards holding area 65, the top edges of the box 181 contact edges 173 of flippers 171. Each flipper 171 has an edge 173 which projects into the path of the full box 181 as it is being moved up by lift plate 64. As the box contacts the edges 173 of flippers 171 the flippers pivot on point 172 and the edges 173 swing up and out of the way of the box. Box 181 then is pushed up past the edge 173 of the flippers 171. Once the box 181 has passed beyond the flippers 171, the edges 173 fall back into the path of the box. Plate 64 then is withdrawn and, since plate 64 is narrower than the gap between the flippers 173, it passes unimpeded. However, the edges of the full box 181 are caught by the edges 173 of the flippers which have swung back into the path of the box and the box 181 is held up and out of the way. A profile view of the box loading area 51 and full box holding area 65 is depicted in FIG. 7A. This is a view that faces towards the box assembler.

5. The Electronic and Mechanical Controls

Figure 10:
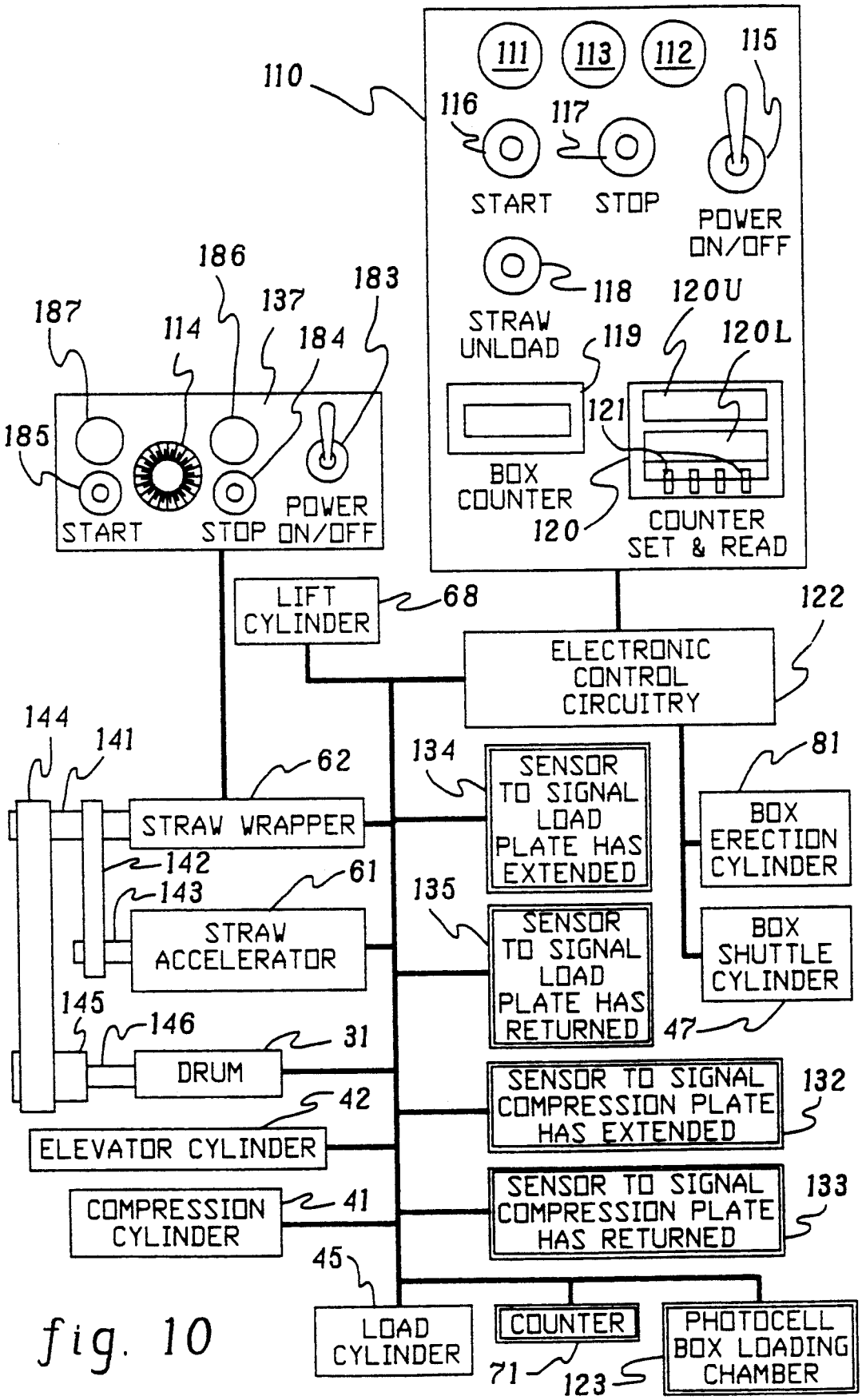
FIG. 10 is a block diagram of the electronic and mechanical controls of the present invention.

The overall configuration of the electronic controls and related circuitry of the invention are depicted in FIG. 10, as a block diagram. The electronic control circuitry 122, FIG. 10 controls the overall operation of the invention. Control of the system described above is provided through control panel 110. The electronic control circuitry 122, in turn, controls the operation of the various parts of the system which are representatively depicted in boxes with single frames. The electronic control circuitry 122 receives feedback from the system regarding the current state of the system and the completion of the various operational steps of the system through the sensors which are representatively depicted in boxes designated with double frame. Panel 137 controls the operation of the straw wrapper 62. However, operation of the straw wrapper 62 is also controlled through electronic control circuitry 122.

Part of the system is interconnected by a mechanical control and power mechanism. A rotatable power and timing shaft 141 forms part of the straw wrapper 62. Power and timing shaft 141 connects to a power and timing shaft 143 of the straw accelerator 61 through belt 142. This interconnection provides power to the straw accelerator 61 and also coordinates the operational velocity of the straw wrapper 62 and straw accelerator 61. Thus, when the operational speed of the straw wrapper 62 is increased there is a corresponding increase in speed of operation of the straw accelerator 61 so both operate in phase with each other. Belt 144 connects timing and power shaft 141 to differential gear system 145. Differential gear system 145 in turn powers the drum 31 through shaft 146. Additionally, shaft 141, belt 144, differential gear system 145 and shaft 146 coordinate the operational velocity of the drum 31 and the straw wrapper 62 so that both operate in phase.

Consequently, a change in the operational speed of the straw wrapper 62 is mechanically transmitted to the drum 31. The drum 31 then will have its operational speed changed to stay synchronized with the operation of the straw wrapper 62 and straw accelerator 61. The mechanical system described above is basic to the art and easily understood by those skilled in the art.

Implementation of the electronic control circuitry 122 can be achieved by two methods: hardwiring or the use of a programmable micro-processor.

Hardwiring is achieved by providing a conventional type of ladder circuitry containing optical sensors, proximity switches, relays and other devices which would control the solenoids that control operation of the cylinders and the other electro-mechanical devices. The proximity switches would be used to detect the existence of a condition which, in turn, would trip a relay to allow a specific act to be performed by the machine. Since the proximity switches produce such a low voltage or current they, in turn, activate relays which then apply the appropriate power necessary to activate the solenoids or other electro-mechanical devices. A detailed schematic of such a hardwiring scheme is not provided since such schemes are well-known in the art.

A second method for providing the electronic control mechanism of the present invention is a programmable micro-processor with proper electronic circuitry. Such devices commonly referred to as E-Proms are well-known in the art. They are essentially programmable micro-processors that can be easily programed by a technician in the field with the proper equipment. With the information provided herein, the necessary program for such a micro-processor as well as the circuitry to implement the operation of the present invention could be easily prepared by those skilled in the art without undue experimentation. Additionally, with the use of a programmable micro-processor, a message screen could be added to the control panel, not shown. Such a message screen could identify for the machine operator specific errors or problems which occur during operation.

In the preferred embodiment, a hardwiring scheme is used since the actual circuitry necessary is quite modest and simple.

As noted above, the operator controls the operation of the system through control panels 110 and 137. Panel 110 has a power on off switch 115 which turns on the power to the system. Sub-panel 120 of panel 110 has keys 121 with which to set the predetermined number of straws to be counted and loaded in each box. Screen 120L states what the count is currently set at. During normal operation the count of straws per box would range from 400 to 600 straws Screen 120U provides a constant current readout of the number of straws deposited in collection chamber 21. At the moment compression plate 43 is activated and pushes the predetermined number of straws to load chamber 23 the number on screen 120U equals the predetermined number of straws to be placed in each box. Immediately thereafter screen 120U resets to zero and start counting anew. Counter 71, a photo cell, provides the running count of the straws deposited in collection chamber 21. Box counter screen 119 provides a constant readout of the total number of boxes filled with predetermined numbers of straws during operation. Light or indicator 113 indicates to the operator the machine is set and operation can start. Light or indicator 111 warns that no assembled box is available to be filed and that the machine will not function until it is provided with an assembled box. In most situations when light 111 goes on it indicates more flat folded boxes have to be put into receiver 86 above erection chamber 79 FIG. 9A. Button 117 FIG. 10 panel 110 allows the operator to stop operation of the machine when desired for any reason. Button 118 allows the operator to complete the load cycle and clear the machine for maintenance or any other desired purpose.

Panel 137 controls the straw wrapper 62. Switch 183 turns on power to the straw wrapper 62. Dial 114 controls the operational speed of the straw wrapper 62 which can be in excess of 600 straws wrapped per minute. The timing shafts and belts described above provide a mechanical means to keep operation of the straw wrapper 62 synchronized with operation of the straw accelerator 61 and drum 31 (FIG. 1). Referring back to FIG. 10 button 185 starts operation of the straw wrapper 62 and indicator or light 187 indicates the straw wrapper has been started and is ready to function. Button 184 stops operation of the straw wrapper 62 and indicator or light 186 indicates that operation of the straw wrapper 62 has been stopped. Even though the straw wrapper 62 has its power turned on and the start button is pushed and indicator 187 goes on, actual operation may not commence until the appropriate signal is received from electronic control circuitry 122. The fact that an assembled box 26 is not available at the load position 51 may be one reason the control circuitry 122 interrupts the operation of the invention and the straw wrapper 62 will not start operation. The failure to secure operator safety guards may be another reason the system will not operate. Consequently lights 186 and 187 serve the useful purpose of indicating to the operator whether the straw wrapper 62 is ready to commence operation or has been put into a stop mode. More concerning this aspect will be provided below.

There are various sensors which provide feedback to the system or electronic control circuitry. The photo cell 123, FIG. 10 and 1 counts for the system the number of straws deposited in chamber 21. Proximity switch 133 FIGS. 10 and 2A to 2C signal the system when compression plate 43 is retracted. Proximity switch 132 FIGS. 10 and 2A to 2C signal the system when compression plate 43 has moved across collection chamber 21 to collection chamber 23. Compression plate 43 has attached thereto a compression plate sensing rod 124 FIGS. 2A to 2C, with a retraction sensing collar 125 and an extension sensing collar 126 attached. When plate 43 is retracted, rod 124 brings retraction collar 125 in contact with proximity switch 133 and when compression plate 43 is moved to a position next to chamber 23 rod 124 brings collar 126 in contact with proximity switch 132.

Loading plate 46 FIG. 1 has a load plate sensing rod 127 attached thereto and attached to the sensing rod 127 is a retraction sensing collar 128 and an extension sensing collar 129. When plate 46 is in a retracted position, sensing rod 127 brings collar 128 in contact with proximity switch 135 and when load plate 46 is extended across box loading chamber 23 sensing rod 127 brings extension collar 129 in contact with proximity switch 134.

Proximity switch 135 when activated tells the system when the loading plate 46 is in a fully retracted position and proximity switch 134 when activated tells the system when loading plate 46 has moved across loading chamber 23 and is adjacent to box loading station 51.

6. Detailed Description of the Operation

The operation of the present invention can be broken down into four major functional cycles:

1. assembling flat folded boxes 26 into fully formed boxes and placing them adjacent to the box loading chamber 23 ready to receive counted and wrapped straws 25;

2. wrapping, counting and depositing the wrapped straws into collection chamber 21;

3. moving the counted and wrapped straws from the elevator plate 43 at its upper position from chamber 21 into chamber 23; and 4. loading the straws in loading chamber 23 into the box adjacent to chamber 23 at box loading station 51. The cycles repeat until interrupted either by the operator or by the control circuitry.

It should be noted that once the present invention commences operation and is functioning properly, all of the operations are continuous. The straws are wrapped and transferred to the collection chamber 21 while being counted along the way. However, when the straws are moved from the collection chamber 21 to the box load chamber 23 the wrapping, counting and depositing of straws 25 into the collection chamber 21 continues unabated. In fact, the continuous functioning of all the cycles and processes of the present invention are one of its advantages.

The operator turns the machine of the present invention on at the commencement of operation with off/on switch 115, FIG. 10. The operator then sets the predetermined number of straws to be packaged in each box with buttons 121. Screen 120L simultaneously displays the number set by the operator. The operator then assures herself that enough unwrapped straws 24 are in the proper bins, that there is wrapping paper for the straws and that unformed flat boxes 26 have been put in box receiver 86. The operator then turns on the straw wrapper with power switch 183 and pushes the start button 185 on panel 137. Indicator light 187 then lights up. The operator then pushes start button 116 on panel 110. Assuming that all safety devices are secured and the machine has been properly maintenanced and loaded, the machine would then commence operation.

As a first step the machine reads photo cell 123, FIGS. 1 and 10, to determine if a formed empty box is positioned adjacent to box loading chamber 23 at box loading station 51 (see FIG. 1). If the system receives a signal that indicates no box is present at box loading station 51, it then goes through a box assembly cycle. The system first places shuttle 49 at the shuttle station 30 (see FIG. 6A) by activating the box shuttle cylinder 47. The next step is activation of box erection cylinder 81 (see FIG. 6A) to erect a box. Box shuttle cylinder 47 then moves the shuttle 49 and the formed empty box it is carrying from shuttle station 30 to box loading station 51 (see FIG. 7A) adjacent to the box loading chamber. Once photo cell 123 (see FIG. 1) signals the system that a formed empty box is adjacent to the box loading chamber 23, the straw wrapper 62 commences operation. The straw accelerator 61 and drum 31 commence operation at the same time since the straw accelerator 61 and drum 31 are powered by the straw wrapper 62 through the mechanical assembly previously described (see FIG. 10). The wrapped straws are transferred from the straw wrapper 62 (see FIGS. 1A and 1) to the straw accelerator 61, then onto the drum 31 and into collection chamber 21. Counter 71 (see FIG. 1 and 10) keeps count of the straws deposited in collection chamber 21 (see FIG. 1). On panel 110 FIG. 10, readout window 120U provides a continuous readout of the number of straws being deposited in chamber 21. Once the count, as indicated by counter 71, reaches the predetermined number, electronic circuitry 122 then activates compression cylinder 41 which drives the compression plate 43 across chamber 21 pushing the straws on floor plate 44 into chamber 23. Immediately thereafter, elevator cylinder 42 activates and moves elevator plate 44 from its upper position to its lower position The straw wrapper, straw accelerator, drum and counter all continue to function.

When compression plate 43 reaches the edge of the box loading chamber 23 (see FIG. 2B), compression plate sensing rod 124 will have moved compression plate extension sensing collar 126 to a position adjacent to proximity switch 132. Proximity switch 132 then activates the electronic circuitry 122 and the electronic circuitry 122 will activate load cylinder 45. Load cylinder 45 then drives load plate 46 across box loading chamber 23 (see FIG. 1), which results in the loading of all straws into the empty box on the opposite side of loading chamber 23. Upon box loading plate 46 reaching the opposite side of loading chamber 23 in its fully extended position, load plate sensing rod 127 brings load plate extension sensing collar 129 in contact with proximity switch 134. Proximity switch 134 then sends the appropriate signal to the electronic circuitry 122. Then the electronic circuitry 122 simultaneously initiates the following three functions: 1.) activates lift cylinder 68 to lift plate 64 and move the full box 181 from the shuttle 49 up to full box holding rack 65, lift cylinder 68 then retracts and moves lift plate 64 back to its originally retracted position; 2.) activates compression cylinder 141 to retract compression plate 43 (see FIG. 2C) back across collection chamber 21 to its retracted position; and 3.) activates load cylinder 45 to retract load plate 46 back across box loading chamber 23 to its retracted position.

Once compression plate 43 is returned to its retracted position (see FIG. 2C), compression plate sensing rod 124 brings retraction sensing collar 125 in contact with proximity switch 133. Accordingly, proximity switch 133 then sends a signal to the electronic control circuitry 122 which in turn activates elevator cylinder 42 and moves elevator plate 44 back to its upper position. Upon load plate 46 being retracted back across chamber 23 (see FIG. 1) load plate sensing rod 127 brings load plate retraction sensing collar 128 in contact with proximity switch 135. Proximity switch 135 then sends a signal to the electronic circuitry 122 which in turn activates cylinder 47 which moves the box shuttle 49 to box shuttle station 30. Then the electronic control circuitry 122 activates box erection cylinder 81 which commences the box erection cycle. The cycles, mentioned above, would all operate continuously until a.) the operator shuts the system down; b.) the machine runs out of flat unformed boxes; or c.) some other error or failure occurs.

While the invention has been particularly shown and described with reference to a preferred embodiment thereof, it will be understood by those skilled in the art that the foregoing and other changes in form and details may be made therein without departing from the spirit and scope of the invention.

We claim:

1. A machine for collecting elongated objects comprising:

a drum having an exterior surface and at least one vane parallel to a central axis of the drum and disposed on the exterior surface of the drum;

means for supporting and rotating the drum;

a collection chamber having an opening adjacent the drum;

means for inserting and positioning at least one of the objects in front of and parallel to the at least one vane so that the object will be moved by the vane and held between the exterior surface of the drum and a curved surface in close proximity to the at least one vane as the drum rotates until the object is positioned adjacent the collection chamber opening; and means for discharging the at least one object into the collection chamber through the chamber opening.

2. The machine of claim 1, wherein there are a plurality of vanes parallel to the central axis of the drum disposed around the exterior surface of the drum and the inserting and positioning means are adapted to insert and position at least one object in front of each vane.

3. The machine of claim 2 further comprising means for determining the number of objects transferred into the collection chamber.

4. The machine of claim 2 further comprising a loading chamber adjacent the collection chamber and means for transferring a predetermined number of the objects from the collection chamber to the loading chamber.

5. The machine of claim 4 wherein the transferring means includes means for determining the number of objects in the collection chamber.

6. The machine of claim 5 wherein the transferring means includes means for moving the predetermined number of objects from the collection chamber to the loading chamber when the predetermined number of objects are present in the collection chamber.

7. The machine of claim 6 wherein the moving means includes means for pushing the predetermined number of objects from the collection chamber to the loading chamber.

8. The machine of claim 7 wherein the pushing means is comprised of a compression plate operable between a retracted and an extended position.

9. The machine of claim 8 wherein the collection chamber is comprised of an elevator plate forming the bottom of the collection chamber and operable between an upper and lower position.

10. The machine of claim 9 wherein the discharging means is adaptable to continuously discharge objects into the collection chamber while the elevator plate is in the upper position, the lower position or therebetween.

11. The machine of claim 10 wherein the loading chamber is in communication with the collection chamber and has a floor coplaner with the elevator plate when the plate is in its upper position.

12. The machine of claim 11 further comprising control means for operating the compression plate from the retracted position to the extended position when the elevator plate is in the upper position.

13. The machine of claim 1 wherein the inserting and positioning means comprises means adjacent to and on a first side of the drum for longitudinally projecting the at least one object in front of the at least one vane.

14. The machine of claim 13 wherein the projecting means comprises two moving parallel endless belts adapted to receive the at least one object therebetween and accelerate it longitudinally.

15. The machine of claim 14 wherein the inserting and positioning means further comprises a backstop to decelerate the at least one object, the backstop being opposite the projecting means on a second side of the drum.

16. The machine of claim 1 wherein the inserting and positioning means comprises a first end plate adjacent a first side of the drum and a second end plate adjacent a second side of the drum, each end plate having an annular groove therein for receiving and guiding an end of the at least one object until the at least one object is positioned adjacent the collection chamber opening.

17. The machine of claim 16 wherein the discharging means comprises a discharge bar pivotally mounted on each end plate to urge the at least one object into the collection chamber.

18. The machine of claim 1 wherein the discharging means comprises an angular surface on a first side of the at least one vane which is at an angle to a normal of an arc of the drum, a projection of the angular surface away from the drum being on an intercept with a second side of the vane, wherein the second side is opposite the first side.

19. The machine of claim 1 wherein the at least one vane includes at least one notch therein and the discharging means comprises at least one stripper finger located adjacent the collection chamber opening and projecting into a rotational path of the at least one notch, wherein the finger is shaped so as to urge the at least one object toward the collection chamber opening as the at least one vane passes the collection chamber opening.

20. The machine of claim 4 in further combination with means for holding an open object container in a loadable position adjacent to the loading chamber and means for loading the objects into the container.

21. The machine of claim 20 wherein the loading means comprises a loading plate operable from a retracted position to an extended position for pushing the objects into the open object container.

22. The machine of claim 21 wherein the transferring means is comprised of a compression plate adapted to hold the objects in position as they are pushed by the loading plate.

23. The machine of claim 21 further comprising means for storing a plurality of unassembled object containers, means for drawing one of said plurality of unassembled object containers from the storing means and assembling same into the open object container and means for placing the open object container in the holding means in the loadable position.

24. A method for continuously collecting and aligning groups of predetermined numbers of elongated objects using a multi-vaned drum, a collection chamber with a floor moveable between an upper and a lower position, a loading chamber adjacent the collection chamber having a bottom plate adjacent to and coplanar with the floor when in its upper position, and an advanceable compression plate for pushing straws from the floor and into the loading chamber, the method comprising:

a. continuously rotating the drum, inserting at least one object in front of each vane of the drum as it rotates and discharging objects seriatim from the drum into the collection chamber onto the floor while performing the following steps:

b. moving the floor to its upper position;

c. counting the objects deposited in the collection chamber until a predetermined number have been deposited therein;

d. advancing the compression plate so as to push the predetermined number of objects from the collection chamber to the loading chamber and holding them there for removal;

e. moving the floor to its lower position predetermined number of objects are being held in the loading chamber by the compression plate;

f. removing the predetermined number of objects from the loading chamber and retracting the compression plate before another predetermined number of objects have been deposited on the floor;

g. moving the floor to its upper position when the compression plate has been retracted; and h. repeating steps b through g.

25. The method of claim 24 wherein the removing step comprises the step of moving the objects into a container.

26. The method of claim 25 in further combination with the steps of periodically erecting folded containers and positioning them one at a time so that a predetermined number of objects can be moved into each of them serially from the loading chamber.

27. The method of claim 26 wherein the erecting step is performed at an erection site and the positioning step includes the step of shuttling each erected container from the erection site to a loading position at the loading chamber.

28. A machine for collecting and loading a plurality of elongated objects into a box erected from a collapsed position, said box having a bottom panel, a first side panel, a second side panel and a top panel, each panel having a flap at each end thereof, the machine comprising:

a box erection chamber comprising a collapsed box holding area at a first end, wherein said box in said collapsed position is held, an erected box holding area at a second end and a box erecting area between said first end and said second end;

means for drawing said box in said collapsed position from said collapsed box holding area through said box erecting area to said erected box holding area;

means in said box erecting area for urging said first side panel into an erect position as said box is drawn through said box erecting area such that said box is erected while being drawn by said bottom panel through said box erecting area;

a drum having an exterior surface and at least one vane parallel to a central axis of said drum and disposed on said exterior surface of said drum;

means for supporting and rotating said drum;

a collection chamber having an opening adjacent said drum;

means for inserting and positioning at least one of said plurality of elongated objects in front of and parallel to said at least one vane, such that said at least one of said plurality of elongated objects is moved by said at least one vane and held between said exterior surface of said drum and a curved surface outside said drum as said drum rotates until said at least one of said plurality of elongated objects is positioned adjacent said collection chamber opening;

means for discharging said at least one of said plurality of elongated objects into said collection chamber through said collection chamber opening; and means for moving said at least one of said plurality of elongated objects from said collection chamber to said erected box for loading thereof.

* * * * *

UNITED STATES PATENT AND TRADEMARK OFFICE

CERTIFICATE OF CORRECTION

PATENT NO. : 5,265,398

DATED : November 30, 1993

INVENTOR(S) : VanAlstine et al

It is certified that error appears in the above-indentified patent and that said Letters Patent is hereby corrected as shown below:

In claim 24 (e), column 21, line 1 after the word "position" and before the word "predetermined" add --for continued reception of objects while the--

Signed and Sealed this

Twenty-eighth Day of June, 1994

*Attest:*

Bruce Lehman

BRUCE LEHMAN

*Attesting Officer*

*Commissioner of Patents and Trademarks*